US012220625B2

(12) United States Patent
Biggs

(10) Patent No.: US 12,220,625 B2
(45) Date of Patent: Feb. 11, 2025

(54) SKATEBOARD TRUCK WITH POSITIVE RETURN TO LEVEL

(71) Applicant: Brandon Biggs, Frazier Park, CA (US)

(72) Inventor: Brandon Biggs, Frazier Park, CA (US)

( * ) Notice: Subject to any disclaimer, the term of this patent is extended or adjusted under 35 U.S.C. 154(b) by 150 days.

(21) Appl. No.: 18/201,035

(22) Filed: May 23, 2023

(65) Prior Publication Data

US 2024/0390770 A1 Nov. 28, 2024

(51) Int. Cl.
*A63C 17/01* (2006.01)
*A63C 17/12* (2006.01)

(52) U.S. Cl.
CPC ..... *A63C 17/012* (2013.01); *A63C 17/12* (2013.01); *A63C 2203/12* (2013.01); *A63C 2203/20* (2013.01)

(58) Field of Classification Search
CPC . A63C 17/012; A63C 17/013; A63C 2203/20; A63C 2203/12
See application file for complete search history.

(56) References Cited

U.S. PATENT DOCUMENTS

| | | | | |
|---|---|---|---|---|
| 4,054,297 | A * | 10/1977 | Solimine | A63C 17/01 280/11.28 |
| 12,053,689 | B1 * | 8/2024 | Oliphant | A63C 17/0093 |
| 2004/0262056 | A1 * | 12/2004 | Ying | A63C 17/01 180/65.1 |
| 2005/0093262 | A1 * | 5/2005 | Chang | A63C 17/01 280/87.042 |
| 2016/0206949 | A1 * | 7/2016 | Murphy | A63C 17/015 |
| 2021/0046994 | A1 * | 2/2021 | Virag | A63C 17/015 |
| 2021/0171132 | A1 * | 6/2021 | Underwood | B62D 51/02 |
| 2023/0330510 | A1 * | 10/2023 | Morgado | A63C 17/017 |
| 2024/0245979 | A1 * | 7/2024 | Cappello | A63C 17/015 |

* cited by examiner

*Primary Examiner* — Brian L Swenson
(74) *Attorney, Agent, or Firm* — Robert Anton Pasic

(57) ABSTRACT

A skateboard truck for supporting a skateboard is disclosed. The truck includes a suspension device for allowing tilt and wheel turning and includes a return to level response to tilting. The truck includes features for allowing adjustment of the steering ratio.

20 Claims, 28 Drawing Sheets

1404 A
3
301
301B
301 C
301 D
706
306
1410
304
1402B
6
1401
1402
1402A
307C
1404

1405A
301
301B
301 C
301D
706
306
3
1411
304
1401
1403
1403A
307C
1405

SKATEBOARD TRUCK WITH POSITIVE RETURN TO LEVEL

CROSS-REFERENCE TO RELATED APPLICATIONS

Not applicable

STATEMENT REGARDING FEDERALLY SPONSORED RESEARCH OR DEVELOPMENT

Not applicable

NAMES OF PARTIES TO A JOINT RESEARCH AGREEMENT

Not applicable

BACKGROUND

The present technology is directed to a skateboard truck apparatus. Skateboarding includes electric skateboards as well as human powered skateboards. One characteristic of a skateboard is the ability to generate a return to level response. This is commonly referred to as return to center response. The disclosure provides a skateboard that has a built-in bias causing it to generate a return to center response. A skateboard may be tilted due to turning or several other reasons. A suspension system that returns to center makes for an improved skateboarding experience and increased safety. The disclosure may provide for both electric and human powered skateboards.

SUMMARY

According to some examples, the present technology is directed to a tilting skateboard truck that has a return to level response. The technology responds to tilting by applying a moment or forces to maintain a level (or horizontal) orientation.

In general, the disclosure provides for a tilting skateboard truck having a base and a suspension linkage. The suspension linkage may include a wheel axle and a pair of torsion bars attached to the wheel axle. The wheel axle may have a pair of torsion bars attached to the wheel shaft and may include a pair of torsion arms and a connecting shaft. The torsion arms may be rigidly attached to the connecting shaft. The suspension linkage may include a spherical bushing supporting the connecting shaft and supported by a base. The spherical bushing may allow rotation about the connecting shaft axis and may also allow rotation perpendicular to the connecting shaft. Additionally, a pair of radius arms each having a first end and a second end may be attached at the first end to the base and the second end to a torsion bar. In some embodiments the radius arms may be located above the transfer arms. In other embodiments the radius arms may be located below the transfer arms.

Included in the disclosure is a suspension system which causes a self-leveling response which is produced by the vertical force on the wheel. The leveling response is transferred from a wheel to the shaft. Through a series of components this leveling response is directed by the radius arms which apply forces to level a tilting skateboard truck. Several trucks on the market today do not provide a self-leveling force directly attributed to the vertical wheel force.

The amount of leveling force is determined by the mechanics of the suspension system. The disclosure includes very adjustments which can be used to determine the desired leveling forces.

DETAILED DESCRIPTION

Figure 1:
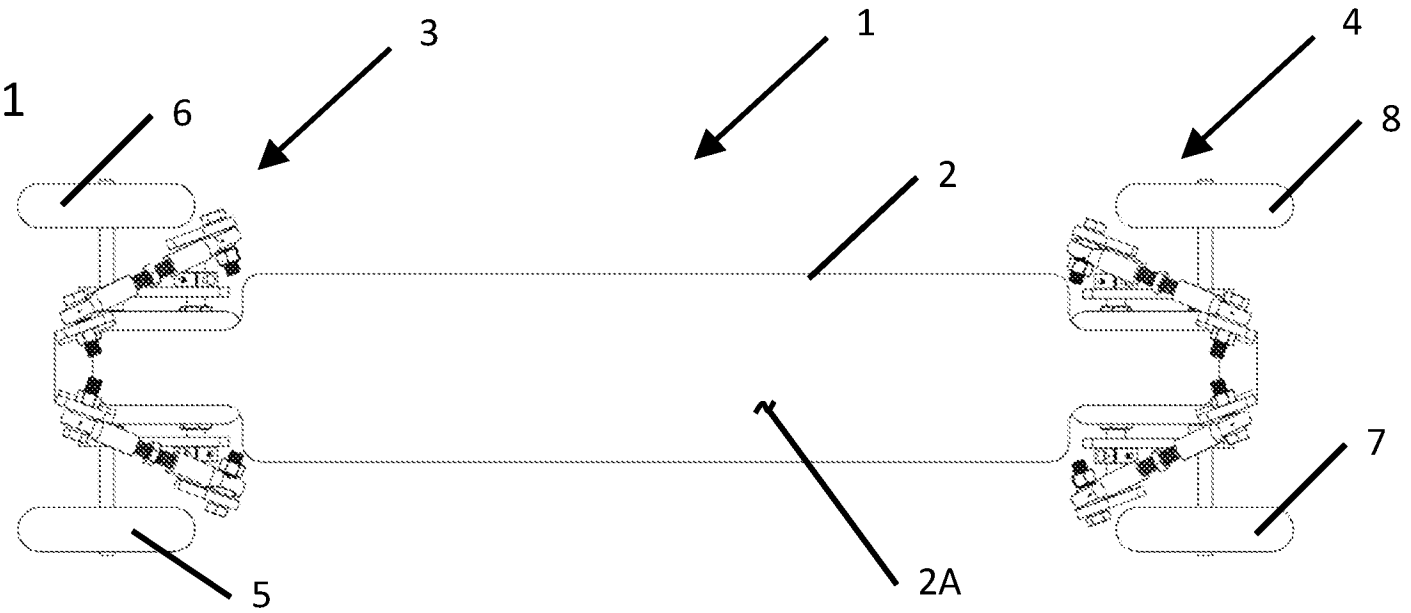
FIG. 1 depicts a top view of a skateboard with a tilting truck.

Various aspects and examples of a tilting skateboard truck, as well as related methods, are described below and illustrated in the associated drawings. Unless otherwise specified, a tilting skateboard truck in accordance with the present teachings, and/or its various components, may contain at least one of the structures, components, functionalities, and/or variations described, illustrated, and/or incorporated herein in connections with the present teachings may be included in other similar devices and methods, include being interchangeable between disclosed examples. The following description of various examples is merely illustrative in nature and is in no way intended to limit the disclosure, its application, or uses. Additionally, the advantages provided by the examples and examples described below are illustrative in nature. The not examples may not provide the same advantages or the same degree of advantages.

This Detailed Description includes the following section, which follows immediately below: (1) Definitions; (2) Overview; (3) Examples; (4) Advantages, Features, and Benefits; and (5) Conclusion.

Definitions

The following definitions apply herein, unless otherwise indicated.

"Comprising," "including," and "having" (and conjugations thereof) are used interchangeably to mean including but not necessarily limited to, and are open-ended terms not intended to exclude additional unrecited elements, or method steps.

Terms such as "first," "second," and "third" are used to distinguish or identify various members of a group, or the like, and are not intended to show serial or numerical limitations.

"AKA" means "also known as," and may be used to indicate an alternative or corresponding term for a given element or elements.

The terms "inboard," "outboard," "forward," "rearward," and the like are intended to be understood in the context of a host vehicle on which systems described herein may be mounted or otherwise attached. For example, "outboard" may indicate a relative position that is laterally farther from the centerline of the vehicle, or a direction that is away from the vehicle centerline. Conversely, "inboard" may indicate a direction toward the centerline, or a relative position that is closer to the centerline. Similarly, "forward" means toward the front portion of the vehicle, and "rearward" means toward the rear of the vehicle. In the absence of a host vehicle, the same directional terms may be used as if the vehicle were present. For example, even when viewed in isolation, a device may have a "forward" edge, based on the fact that the device would be installed with the edge in question facing in the direction of the front portion of the host vehicle.

"Coupled" means connected, either permanently or releasably, whether directly or indirectly through intervening components.

"Resilient" describes a material or structure configured to respond to normal operation loads (e.g. when compressed) by deforming elastically and returning to an original shape or position when unloaded.

"Rigid" describes a material or structure configured to be stiff, non-deformable, or substantially lacking in flexibility under normal operation conditions.

"Elastic" describes a material or structure configured to spontaneously resume is former shape after being stretched or compressed.

"Providing," in the context of a method, may include receiving, obtaining, purchasing, manufacturing, generating, processing, preprocessing, and/or the like, such that the object or material provided is in a state and configuration for other steps to be carried out.

"Operatively," describes a connection between two devices or entities such that a function is provided from one entity to another. For example, a first entity may be operatively connected to a second entity for transferring force. In this example, a connection between first and second entity may be by gears, a belt, solder, or weld such that force (or torque) is transferred from first entity to second entity.

"Force," and "torque," in this disclosure includes positive and negative values. For instance, force provided to object one from object two means, object one pushes or pulls on object two and/or object two pushes or pulls on object one.

"Stress," in this disclosure refers to force acting on any infinitesimal area located inside a load carrying member divided by the infinitesimal area. The direction of force relative each infinitesimal area determines the type of stress. "Tensile stress" refers to the stress acting perpendicular away from the infinitesimal area. "Compressive stress" refers to the stress acting perpendicular and into the infinitesimal area. "Shear stress" refers to the stress acting parallel to the infinitesimal area. Tensile stress in a negative direction is compressive stress. "Normal stress" refers to both tensile stress and compressive stress, for example a member may carry tensile stress or compressive stress depending on external loads. In this case the member carries normal stresses.

"Pitch" within this disclosure refers to an axis of rotation which is generally perpendicular to the vertical direction and the direction of travel. Pitch angle describes a front up or a front down orientation of a component.

In this disclosure, one or more publication, patents, and/or patent application may be incorporated by reference. However, such material is only incorporated to the extent that no conflict exists between the incorporated material and the statements and drawings set forth herein. In the event of any such conflict, including any conflict in terminology, the present disclosure is controlling.

Overview

Generally, the present disclosure pertains to devices and methods for a skateboard truck. A skateboard truck is used to support a skateboard on which an operator is positioned.

Disclosed is a skateboard truck having a suspension linkage and a base The suspension linkage includes a wheel axle, a pair of torsion bars attached to the wheel axle, a connecting shaft connecting the torsion arms, a pair of torque arms rigidly attached to the connecting shaft, and a connecting shaft supported by a base spherical bushing.

Also disclosed is a skateboard truck that is adjustable for converting wheel forces to a desired leveling response.

Additionally, methods of adjustment are disclosed. This allows the operator to adjust the leveling response as desired.

EXAMPLES

I. Single Wheel Shaft Truck

Figure 2:
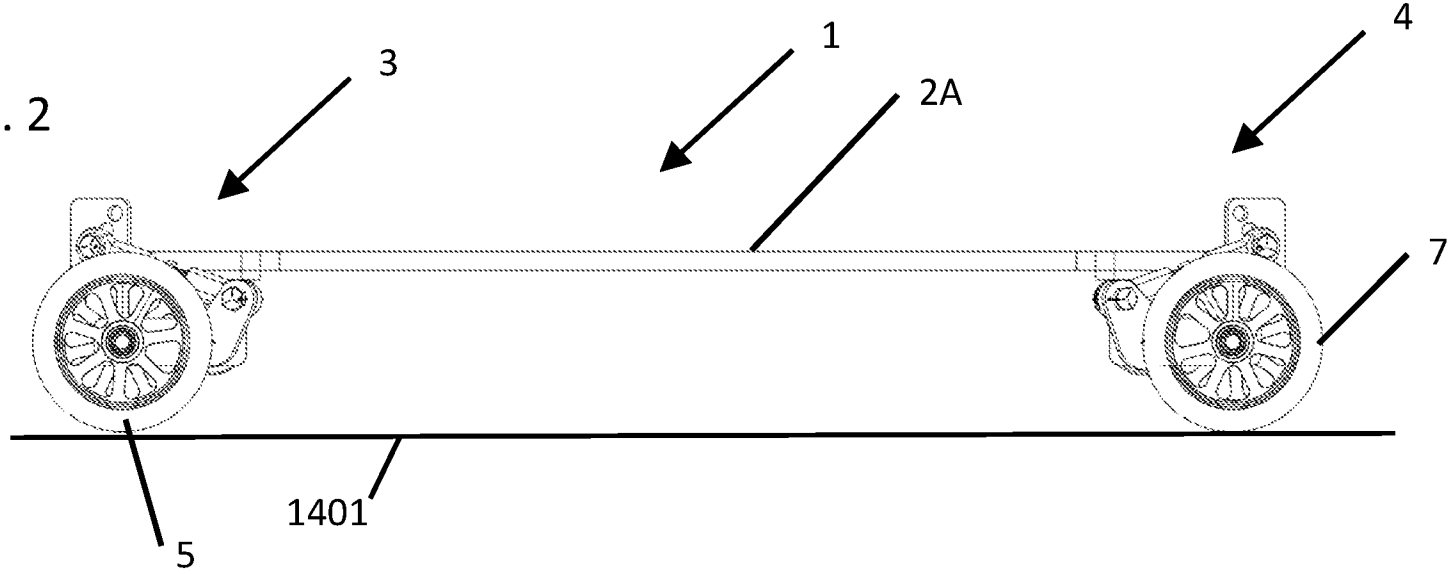
FIG. 2 depicts a side view of a skateboard with a tilting truck.

FIGS. 1 and 2 depict a skateboard 1 which includes board 2, tilting skateboard truck 3 on one end of board 2, a second tilting skateboard truck 4 attached on a second end of board 2. In some examples, tilting skateboard truck 4 may be an electrically powered skateboard truck for driving skateboard 1. During operation the skateboard 1 supports a user on the top surface 2A and the skateboard 1 is supported by wheels 5, 6, 7, and 8. Wheels 5, and 6 are attached to tilting skateboard truck 3, and wheels 7 and 8 are attached to tilting skateboard truck 4.

Figure 3:
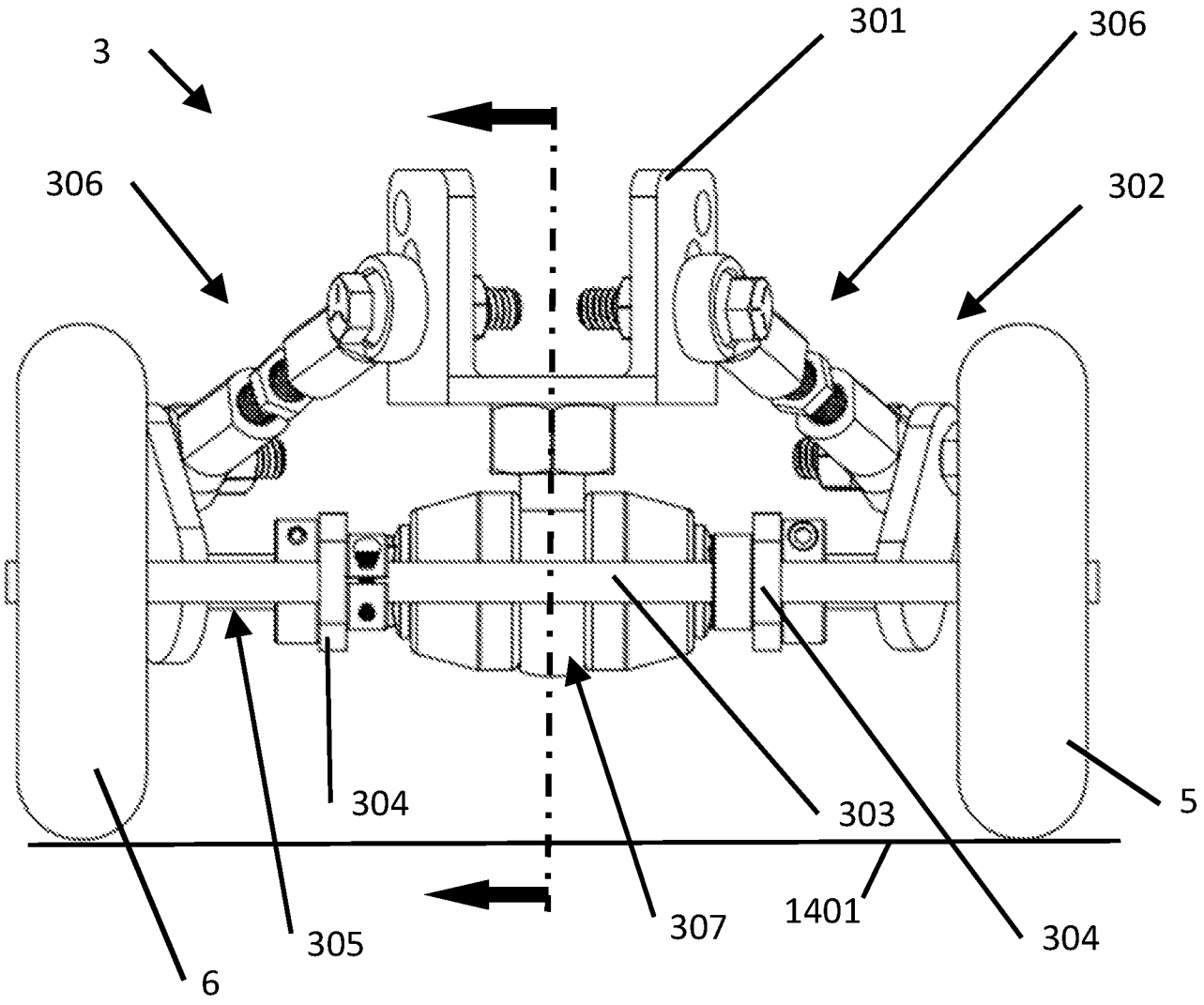
FIG. 3 depicts a front view of a skateboard truck.

FIG. 3 depicts a front view tilting skateboard truck 3. Base 301 supports suspension linkage 302. Suspension linkage 302 may support wheels 5 and 6 against ground 1401. Base 301 may be attached to board 2. Suspension linkage 302 may be supported by base spherical bushing 307 attached to base 301.

Suspension linkage 302 may include, wheel shaft 303, a pair of torsion bars 304, connecting shaft 305, and a pair of radius arms 306.

Wheel shaft 303 may be included in suspension linkage 302 for rotationally supporting wheels 5 and 6. Wheel shaft 303 may transfer loads on wheels 5 and 6 to base 301. This transference of loads is achieved through suspension linkage 302.

Figure 4C:
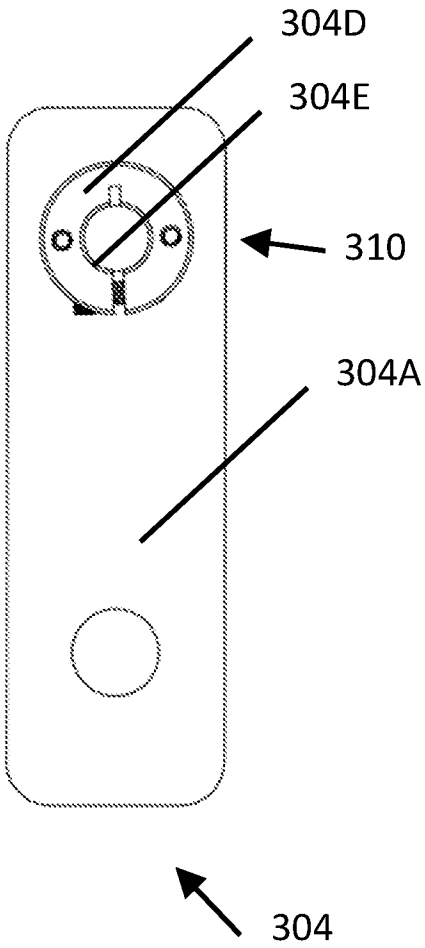
FIG. 4C depicts a right side view of a torque arm.
Figure 4B:
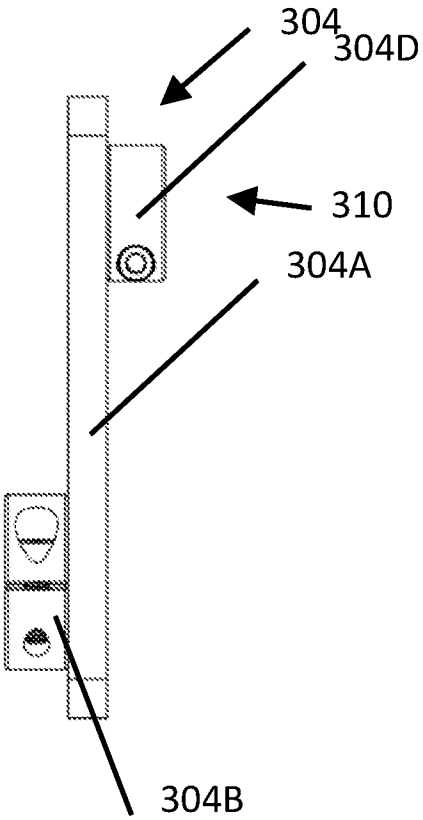
FIG. 4B depicts a top view of a torque arm.
Figure 4A:
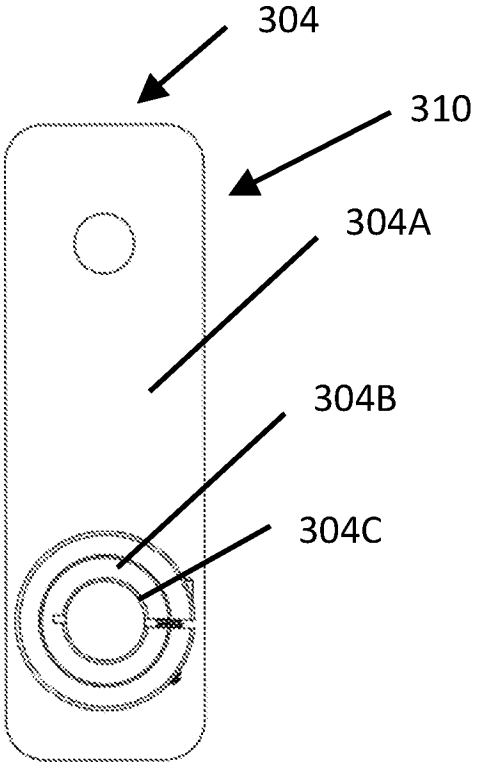
FIG. 4A depicts a left side view of a torque arm.

Torsion bars 304 (best shown in FIGS. 4A, 4B, and 4C) may be rigidly attached to wheel shaft 303 by a first attachment feature 310. In some examples, first attachment feature 310 may be a first collar feature 304D on first collar surface 304E. Torsion bar 304 may be rigidly attached to connecting shaft 305 by a second attachment feature. In some examples, second attachment feature may be a second collar feature 304B on second collar surface 304C and connecting shaft body 305A (see FIG. 6A). Torsion bar 304 also may include torsion bar body 304A for locating first collar feature 304D and second collar feature 304B.

Figure 5:
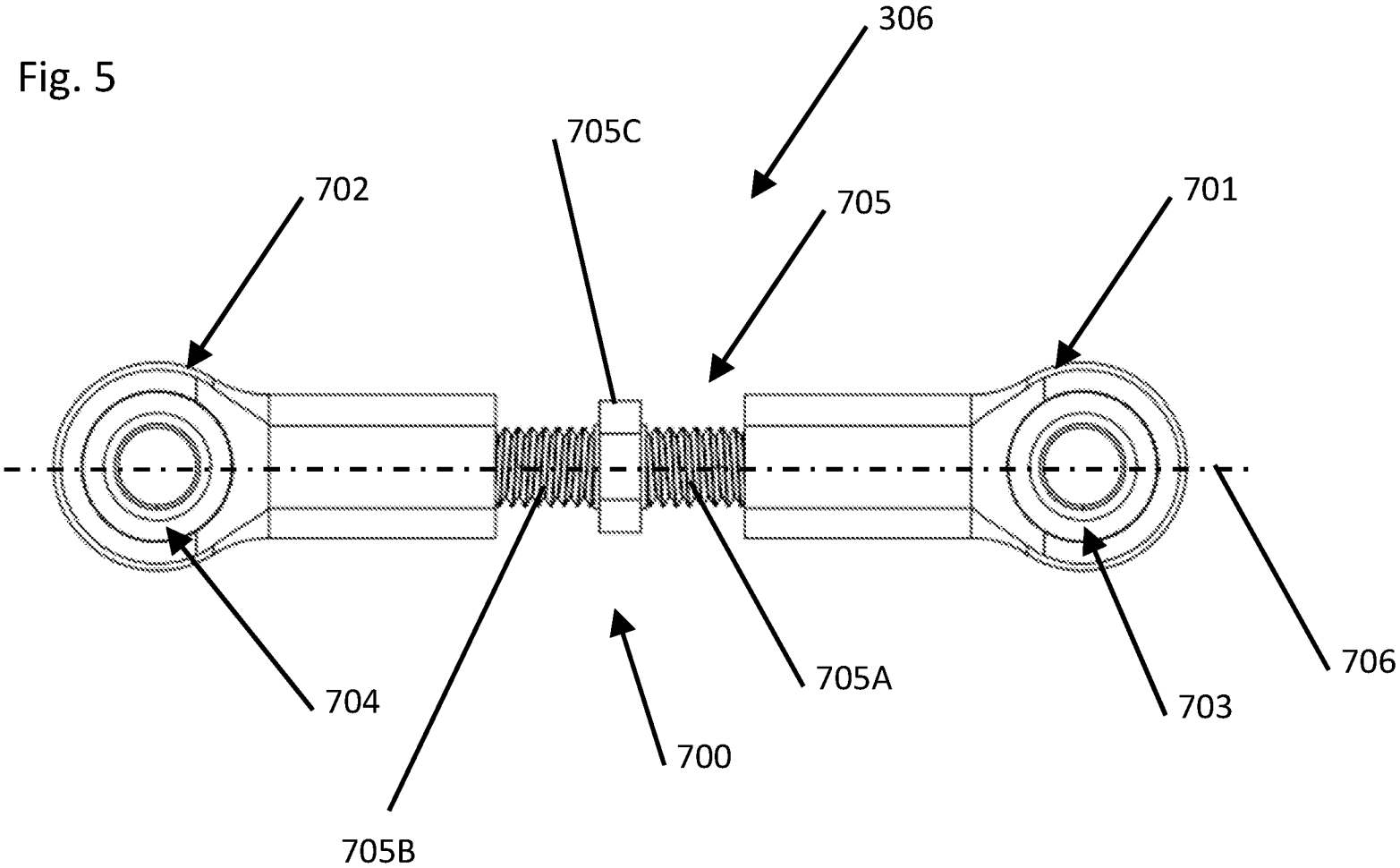
FIG. 5 depicts a side view of a radius arm.

Radius arms 306 support connecting shaft 305 at radius arm connecting feature 305C. In some examples, torque arm radius arm connecting feature may be a hole 305C and is in turn supported on base 301. FIG. 5 depicts a radius arm 306 which may include several features. Radius arm 306 may include a length adjustment device 700. In some examples, length adjustment device 700 may include a left hand rod end 701, a right hand rod end 702 and a length adjust screw 705. Left hand rod end 701 and right hand rod end 702 may include spherical bushings 703 and 704 respectively. Spherical bushings 703 and 704 provide rotation about a single point and so are allowed to pivot to align with bolts in mounting holes. Left hand rod end 701 may include left hand threads for engagement with left hand external threads 705A on length adjust screw 705. Right hand rod end 702 may include right hand threads for engagement with right hand external threads 705B. By rotating length adjust screw 705 relative to the left hand rod end 701 and right hand rod end 702 the rod ends move toward or away from each other. Turn feature 705C may be included on length adjust screw 705. Therefore the length of the radius arms 306 may be adjusted. In some examples, length adjustment device 700 may be constructed using shafts and clamps, wedges, and other means. Any device which can adjust the radius arm length may act as length adjustment device 700 and satisfy this disclosure. Additionally, the length adjustment device 700 may include internal left hand and right hand threads as part of the length adjust screw 705 and left hand rod end 701 may include external left hand threads and right hand rod end 702 may include external right hand threads. The disclosure example only needs to allow for length adjustment of radius arm 306.

Figures 6A, 6B, 6C:
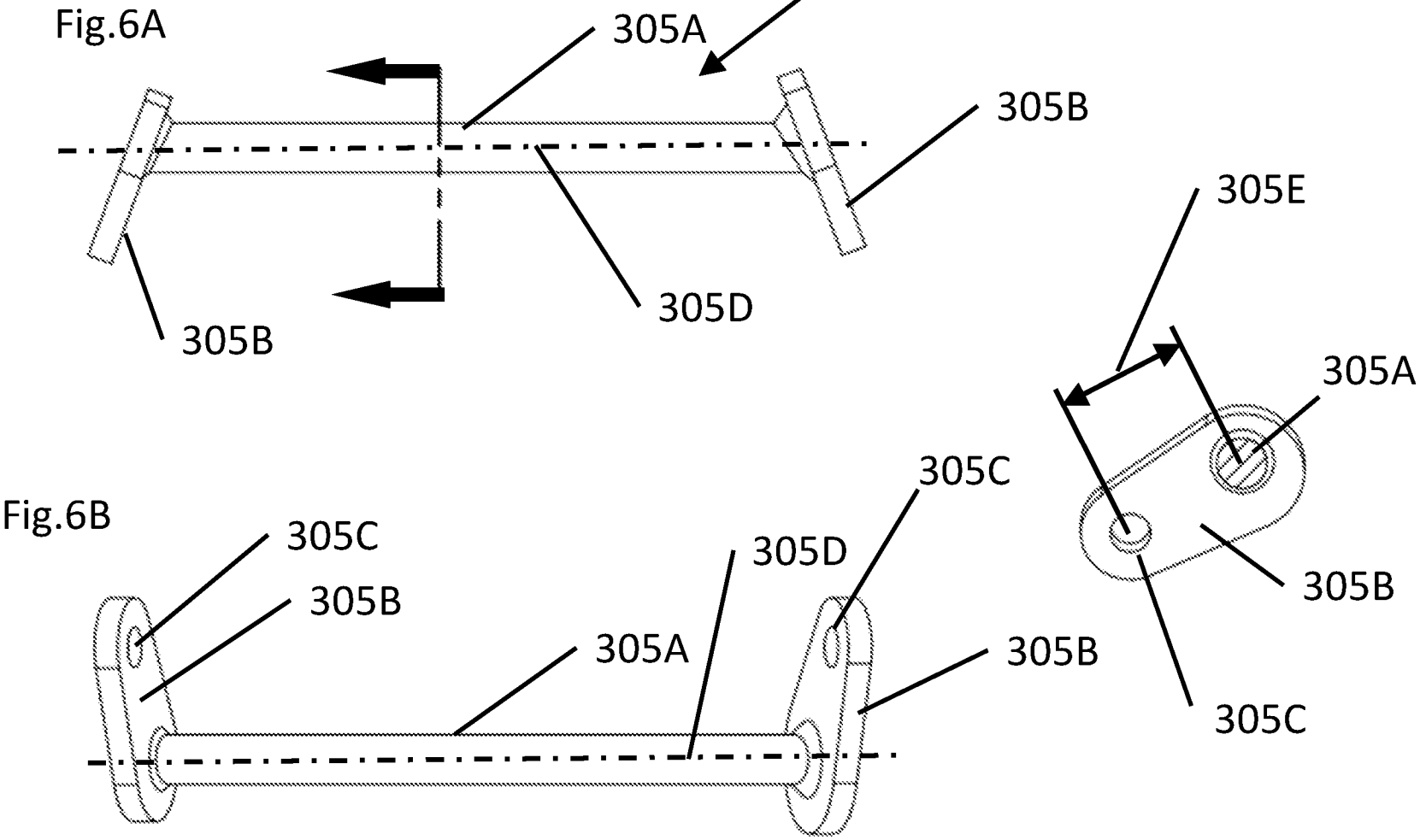
FIG. 6A depicts a top view of a connecting shaft.
FIG. 6B depicts a front view of a connecting shaft.
FIG. 6C depicts a cross sectional view indicated in FIG. 6A.

FIGS. 6A, 6B, and 6C depict connecting shaft 305. Connecting shaft 305 may include a pair of torque arms 305B and connecting shaft body 305A. Torque arms 305B may include radius arm attachment features 305C. In some examples, radius arm attachment features 305C may be holes in other examples, radius arm attachment features 305C may be threaded rods, pins, rivets, or any other feature that will secure radius arm spherical bushings 701 or 702 to torque arms 305B. Radius arm attachment features 305C may be located a distance 305E from connecting shaft axis 305D.

Figure 7:
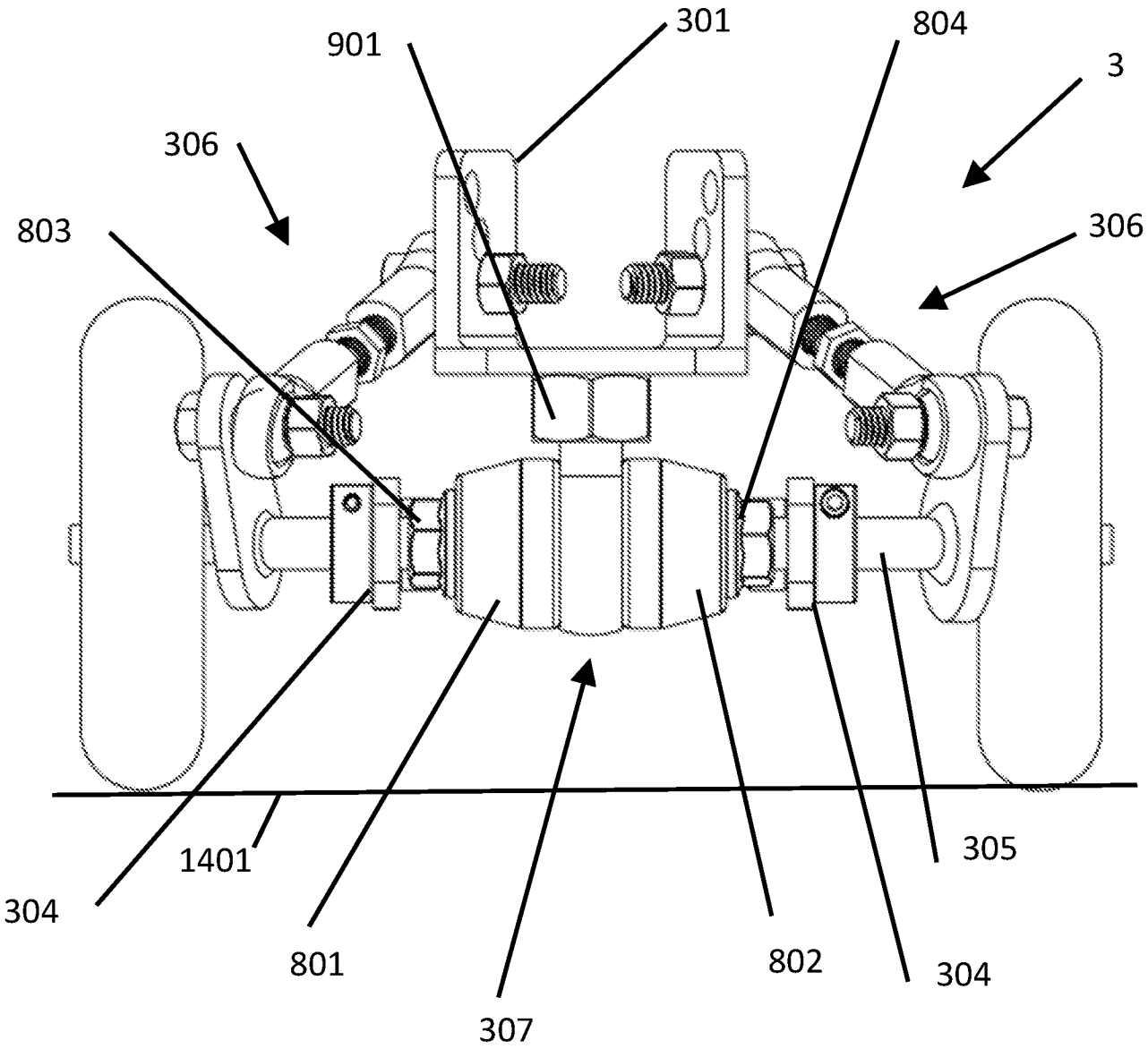
FIG. 7 depicts a rear view of a tilting truck.

FIG. 7 depicts connecting shaft 305 supported by base spherical bushing 307 attached to base 301. Base spherical bushing 307 may be rigidly connected to connecting shaft body 305A and allow for rotation about a point. Connecting shaft 305 may include elastic bushings 801 and 802 located on connecting shaft body 305A and adjacent to base spherical bushing 307. Elastic bushings 801 and 802 are supported along connecting shaft body 305A by nuts 803 and 804 respectively. Elastic bushings 801 and 802 may be preloaded against base spherical bushing 307.

Figure 8:
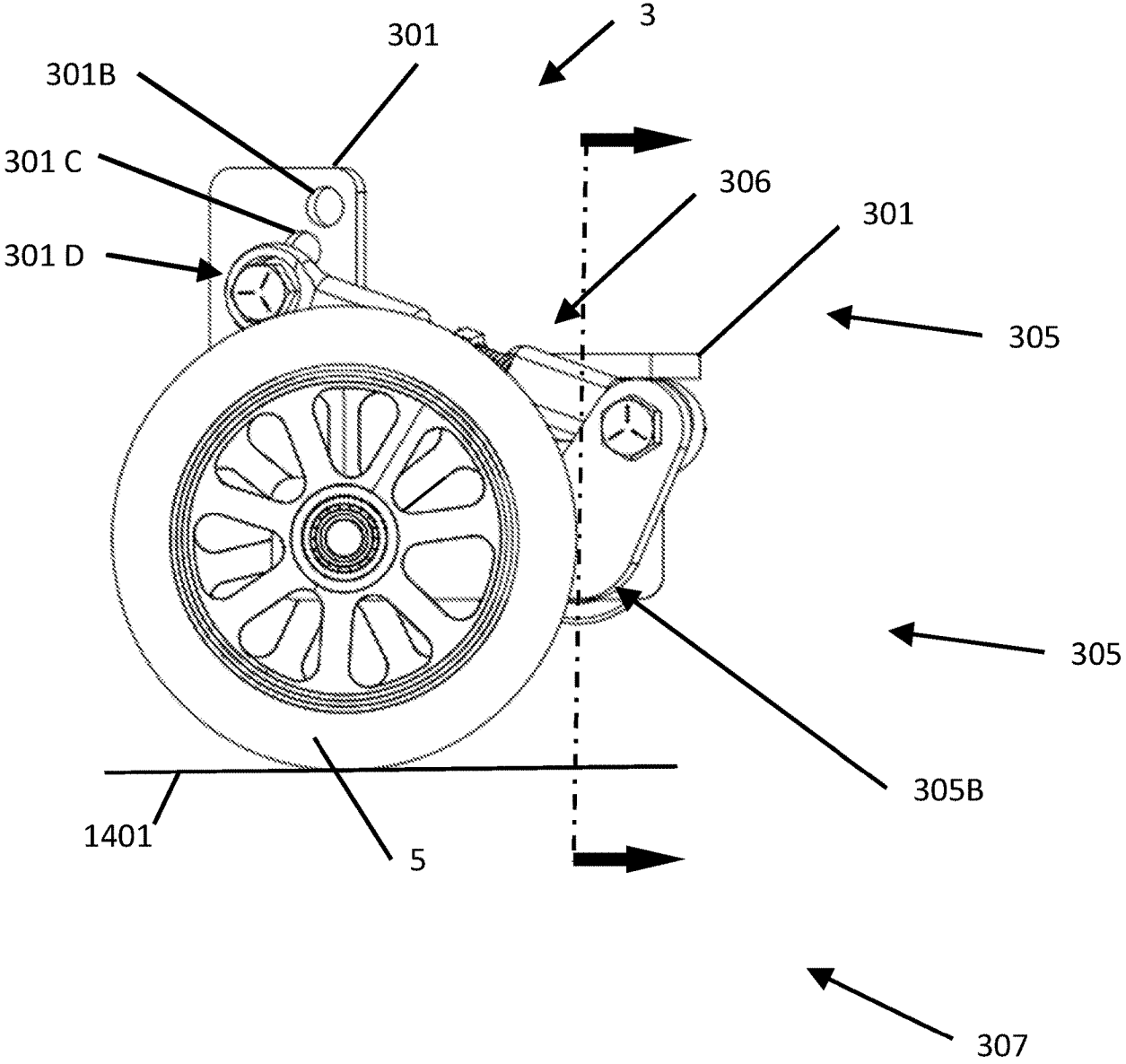
FIG. 8 depicts a side view of a tilting truck.
Figure 9:
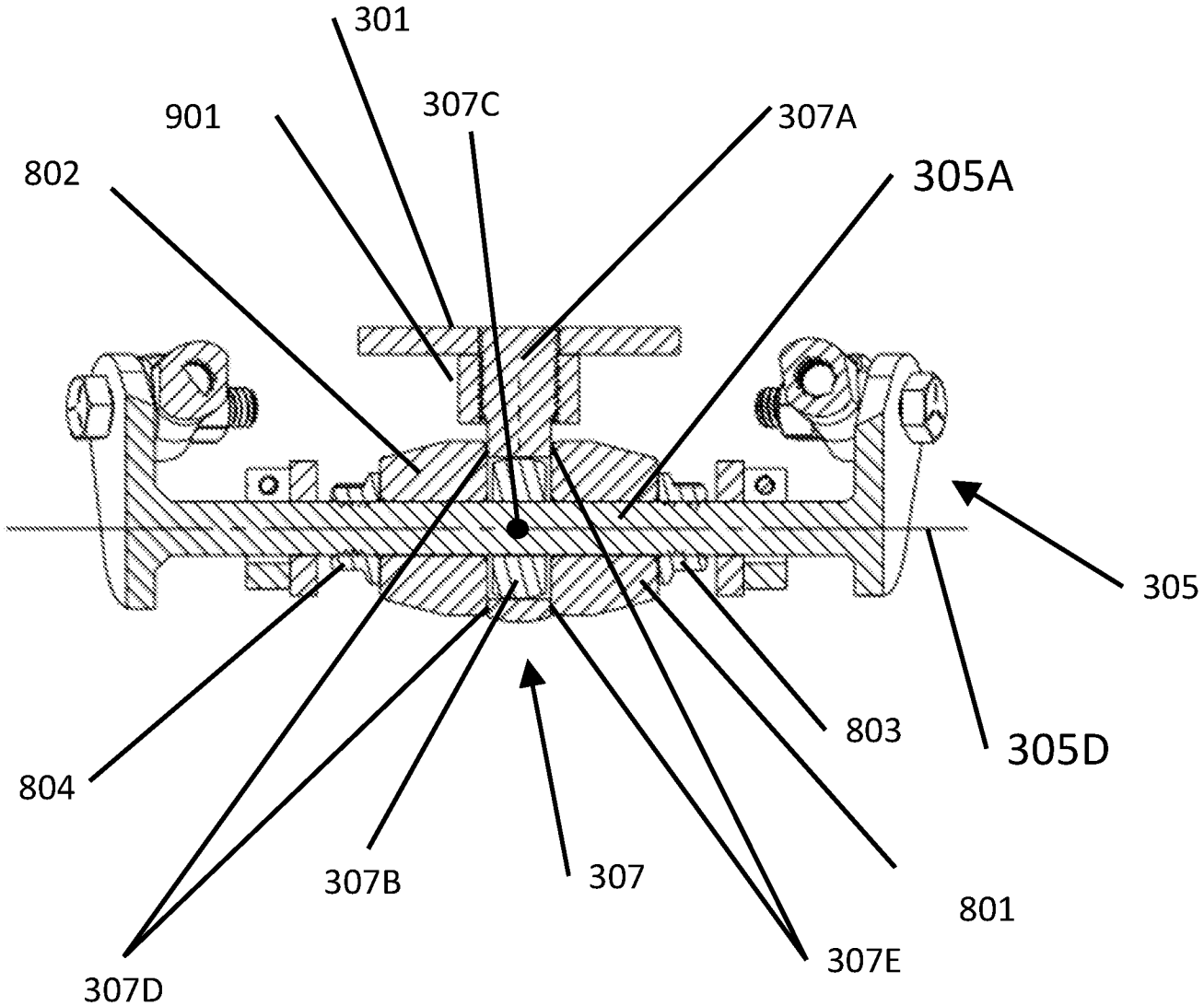
FIG. 9 depicts a cross sectional view indicated in FIG. 8.

FIG. 8 depicts a side view of tilting skateboard truck 3 and indicates the location of cross section view depicted in FIG. 9. Referring to FIG. 9, connecting shaft 305 is supported by base spherical bushing 307. Base spherical bushing 307 may include a spherical insert 307B that is supported by spherical base 307A. Spherical insert 307B is supported such that rotation about rotation point 307C may occur in any direction. Rotation point 307C is held in a fixed location along connecting shaft axis 305D. Spherical insert 307B is also held in a fixed location by spherical base 307A relative to base 301. This allows radius arms 306 to push and pull connecting shaft 305 about rotation point 307C. The applicant has found that vertical loads on wheels 5 and 6 transferred through suspension linkage to base 301 causes a response when base 301 is tilted. Connection shaft 305 may also be supported by base spherical bushing 307 and elastic bushings 801 and 802.

Elastic bushing 801 may be preloaded against spherical bushing side 307D and elastic bushing 802 may be preloaded against spherical bushing side 307E. Elastic preload nut 803 may be threadedly attached to connection shaft 305 along connecting shaft body 305A. Tightening elastic preload nut 803 causes elastic bushing 801 to be pressed against spherical bushing side 307E. Elastic preload nut 804 may be threadedly attached to connection shaft 305 along connecting shaft body 305A. Tightening elastic preload nut 804 causes elastic bushing 802 to be pressed against spherical bushing side 307D. Pressing elastic bushing 801 and 802 against spherical bushing sides 307E and 3074D causes resistance to rotation of connecting shaft 305 about rotation point 307C. Elastic bushings 801 and 802 provide a leveling response through suspension linkage 302 to base 301.

Figure 10:
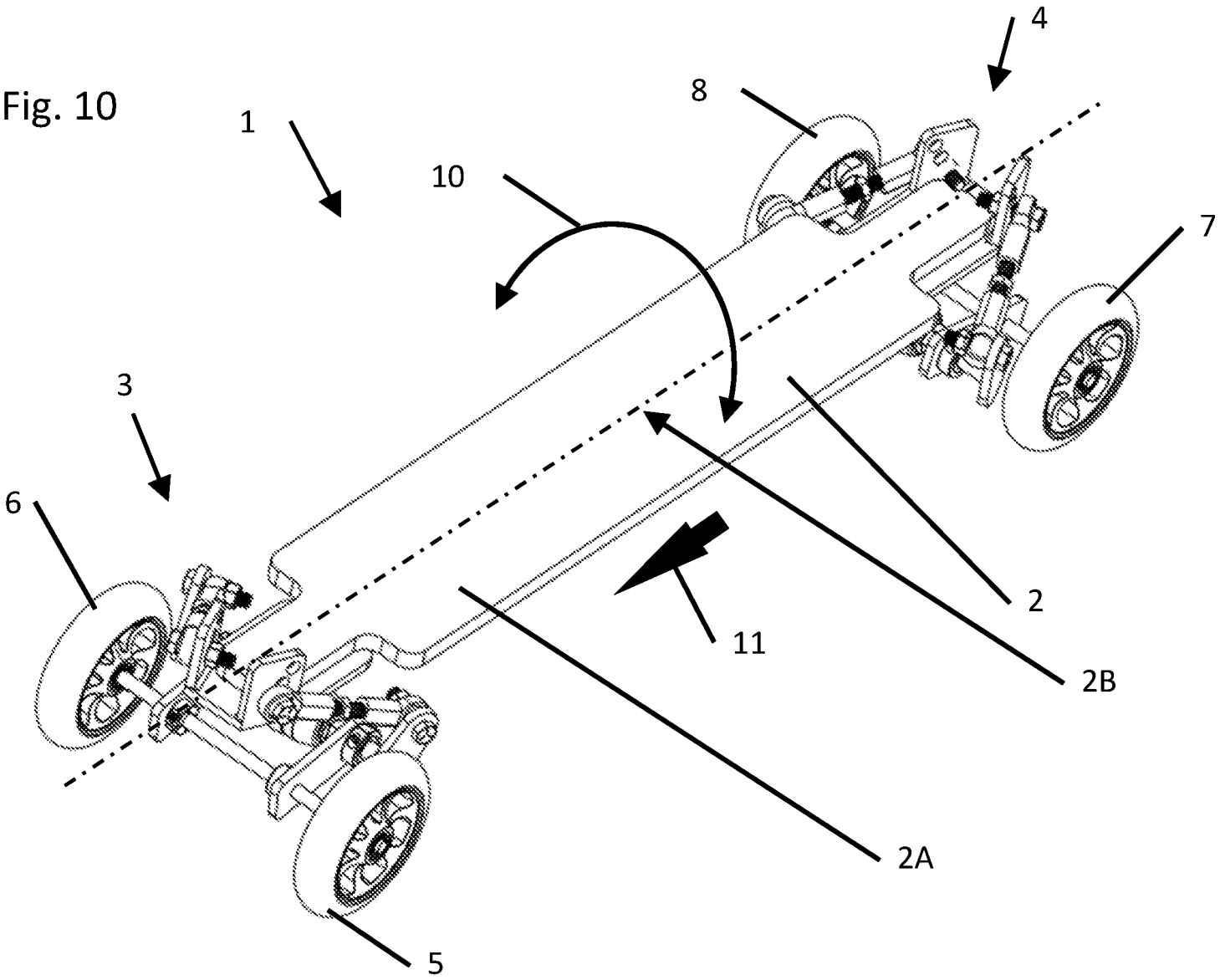
FIG. 10 depicts an isometric view of a skateboard.
Figure 11:
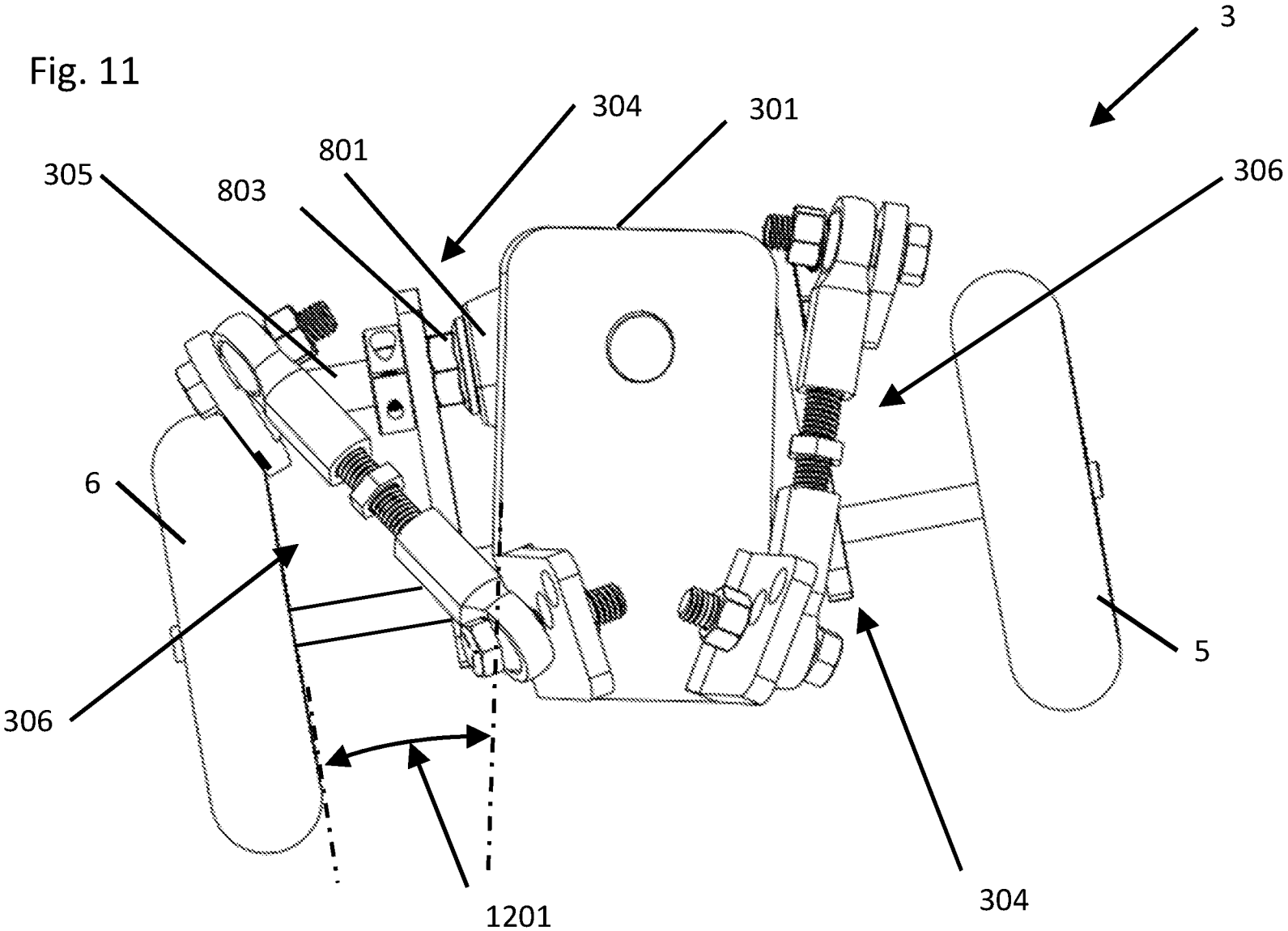
FIG. 11 depicts a top view of a tilted tilting skateboard truck.

During use board 2 may be tilted about board axis 2B (best seen in FIG. 10) indicated by tilt arrow 10. Additionally, a typical direction of travel is in the direction indicated by arrow 11. Suspension linkage 302 turns wheels 5 and 6 as board 2 is tilted about board axis 2B. This is shown best in FIG. 11. Base 301 is tilted in this top view and wheels 5 and 6 turn at angle 1201. This causes the direction of travel to change. The angle of radius arms 306 may determine the steering ratio. The steering ratio is the angle of tilt of board 2 to the size of angle 1201. As the radius arms 306 are angled the steering ratio is increased and as radius arms 306 are less angled the steering ratio is decreased. The steering ratio affects the response of the skateboard and helps the operator control the skateboard. The steering ratio also determines the stability of tilting skateboard truck 3 when going straight.

The applicant has also found that radius arms 306 are loaded against connecting shaft 305 and base 301 such that a return to level response is established. This is generally a result of radius arms 306 located above torsion bar 304 and translation of a vertical force on wheels 5 and 6 to base 301 using suspension linkage 302. Suspension linkage 302 may also use bushings 801 and 802 to establish a return to level response.

Figure 12:
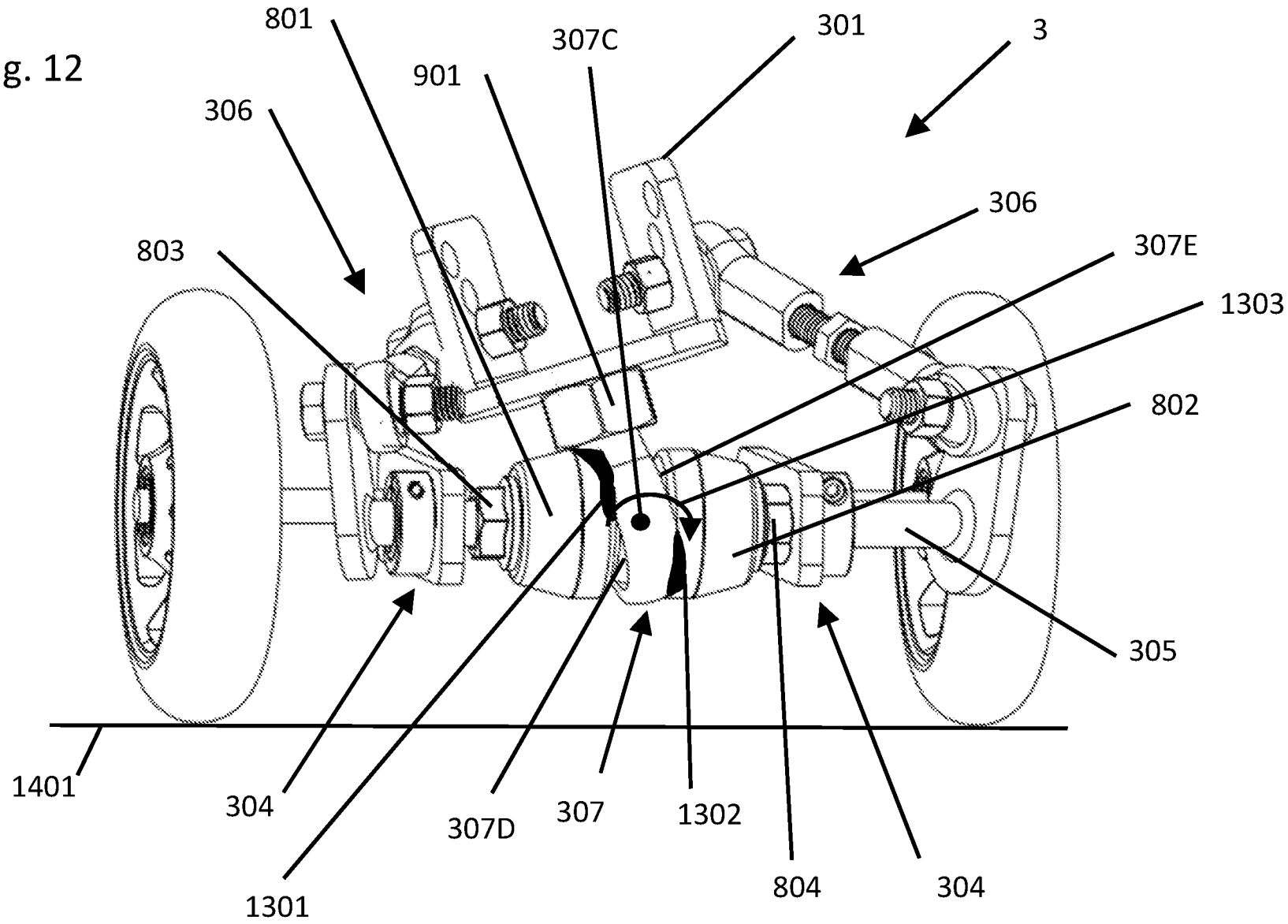
FIG. 12 depicts a rear view of a tilted tilting skateboard truck.

FIG. 12 depicts tilting skateboard truck 3 in a tilted orientation. As a result of positioning elastic bushings 801 and 802 against spherical bushing side 307D and spherical bushing side 307E of spherical bushing base 307A compression zones 1301 and 1302 develop when base 301 is tilted. Compression zones 1301 and 1302 cause torque indicated by arrow 1303 to act on spherical bushing body 307E and connecting shaft 305. This torque acts on the base 301 and causes base 301 to resist the tilting and cause a return to level response.

Figures 13A, 13B:
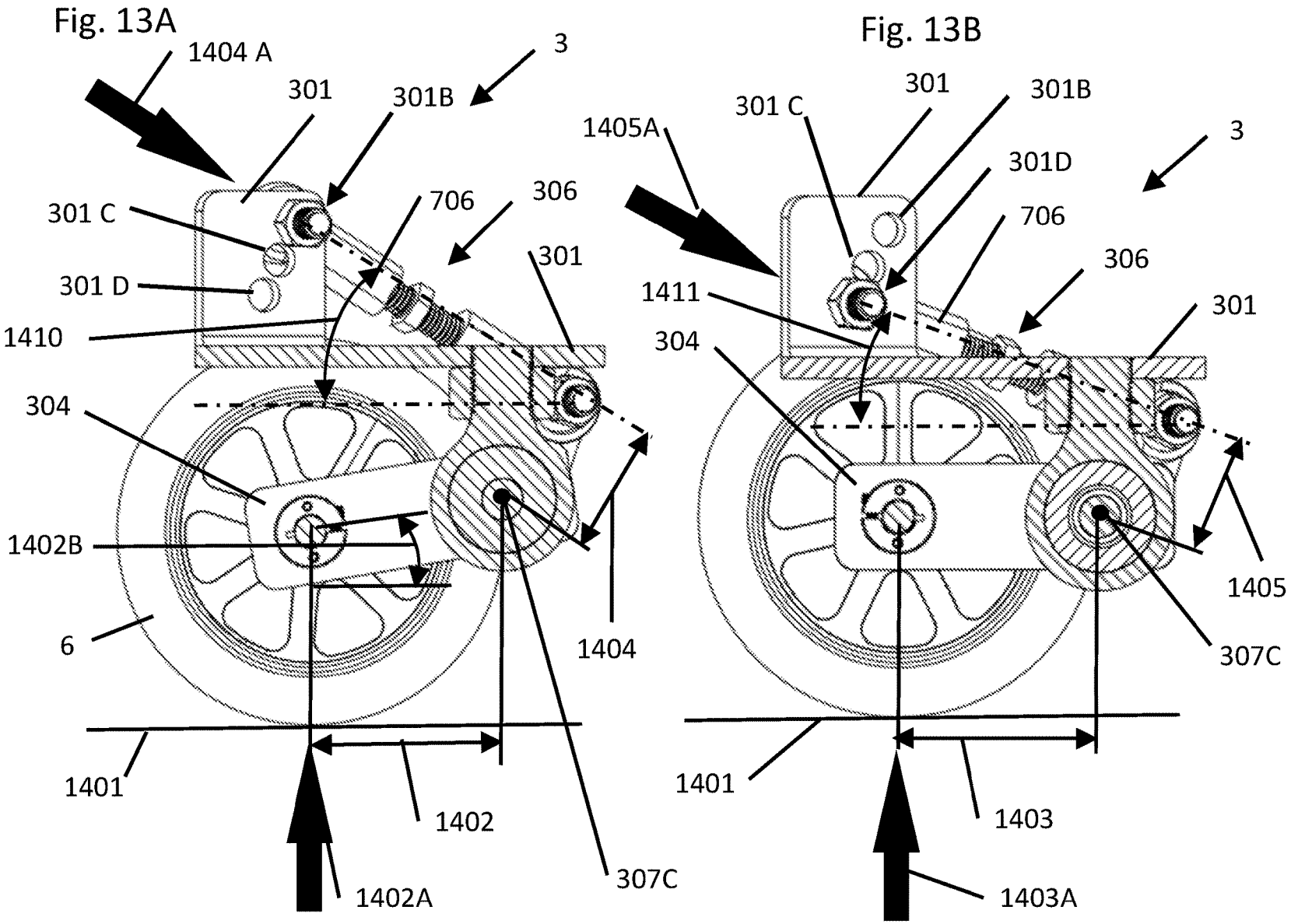
FIG. 13A depicts a cross section view indicated in FIG. 3 with a radius arm attached to first attachment feature.
FIG. 13B depicts a cross section view indicated in FIG. 3 with a radius arm attached to a third attachment feature.

Radius arms 306 may also be adjusted to affect the response to wheel forces. In some examples, radius arms 306 may be attached to base 301 in different locations such as at first attachment feature 301B, second attachment feature 301C, and third attachment feature 301D. FIGS. 13A and 13B depict tilting skateboard truck 3 using first attachment feature 301B and third attachment feature 301D. In FIG. 13A radius arm 306 is attached to the base at first attachment feature 301B this causes torsion bar 304 to be oriented at angle 1402B relative to ground 1401. This positions force 1402A to be distance one 1402 from rotation point 307C. To react to force 1402A radius arm 306 provides force 1404A which is positioned at distance two 1404 from rotation point 307C. In FIG. 13B radius arm 306 is attached to base 301 at third attachment feature 301D this causes torsion bar 304 to be parallel to ground 1401. This positions force 1403A to be distance three 1403 from rotation point 307C. To react to force 1403A radius arm 306 provides force 1405A which is positioned at distance four 1405 from rotation point 307C. Distance three and distance four are substantially equal in length. It is well understood in the art that for a given force 1402A and 1403A applied by an operator forces 1404A and 1405A acting along radius arm 306 will differ. The tilting skateboard truck 3 responses to the operator differently adjusted in FIG. 13A than when adjusted as in FIG. 13B. Changing the attachment location of radius arms 306 at base 301 also changes the steering ratio of truck 3.

The steering ratio of tilting skateboard truck 3 is adjusted by changing radius arm angle 1410 shown in FIG. 13A to radius arm angle 1411 shown in FIG. 13B. The radius arm angle is the angle of radius arm axis 706 to horizontal. Larger radius arm angle 1410 (shown in FIG. 13B) results in a larger steering ratio and smaller radius arm angle 1410 (shown in FIG. 13B) results in a smaller steering ratio. In FIG. 13A radius arm 306 is attached to the base at first attachment feature 301B this causes radius arm 306 to be supported at angle 1410. In FIG. 13B radius arm 306 is attached to base 301 at third attachment feature 301D this causes radius arm 306 to be supported at angle 1411. Angle 1410 is larger than angle 1411 and angle 1410 provides a larger steering ratio. Suspension linkage 302 may include radius arm length adjustment.

Radius arms 306 may be adjusted in length. FIG. 5 depicts radius arm 306. Radius arms 306 may have left hand rod end 701 and right-hand rode end 702 that are adjustable by securing spherical bushings 703 and 704 and turning length adjust screw 705. Length adjust screw 705 may have left hand threads 705B and right-hand threads 705A. Adjustment of radius arm 306 length may be changed by rotating length adjust screw 705 relative to left hand rod end 701 and right-hand rod end 702. Adjusting the radius arm 306 length may have a desirable effect on tilting truck 3. Although left- and right-hand threads have been used in this example, other devices may be used to adjust radius arm 306 length and include wedges, shaft clamps, and other mechanisms. The disclosure example only needs to allow for length adjustment of radius arm 306. The location of rotation pivot 307C may be adjusted.

Figure 14:
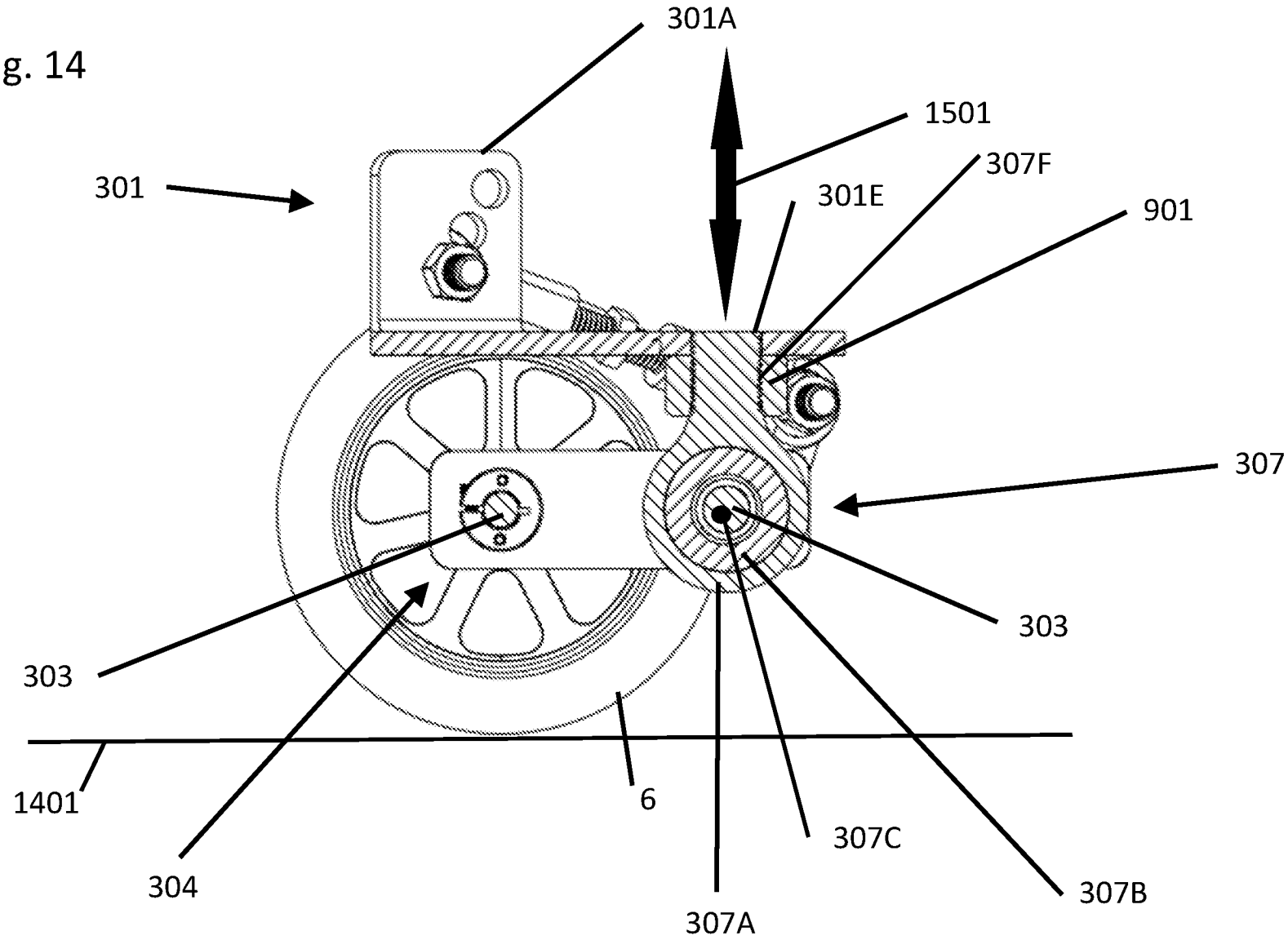
FIG. 14 depicts a cross section view indicated in FIG. 3.

Rotation point 307C is shown in FIG. 14 and is located at the center of spherical insert 307B and is also coincident with the center of connecting shaft axis 305D. Spherical bushing body 307A may include external threads 307F which may be screwed into base 301 at spherical bushing attach threaded hole 301E. Nut 901 may be used to fix spherical bushing body 307A in place by tightening nut 901 against base 301. Adjusting the location of rotation point 307C upward or downward as indicated by arrow 1501 may be accomplished by rotating spherical bushing base 307A relative to base 301 then fixing it in place by tightening nut 901 against base 301. Adjusting the location of rotation point 307C may provide desirable effects of tilting skateboard truck 3. Torsion bars 304 may be adjusted also.

Figure 15:
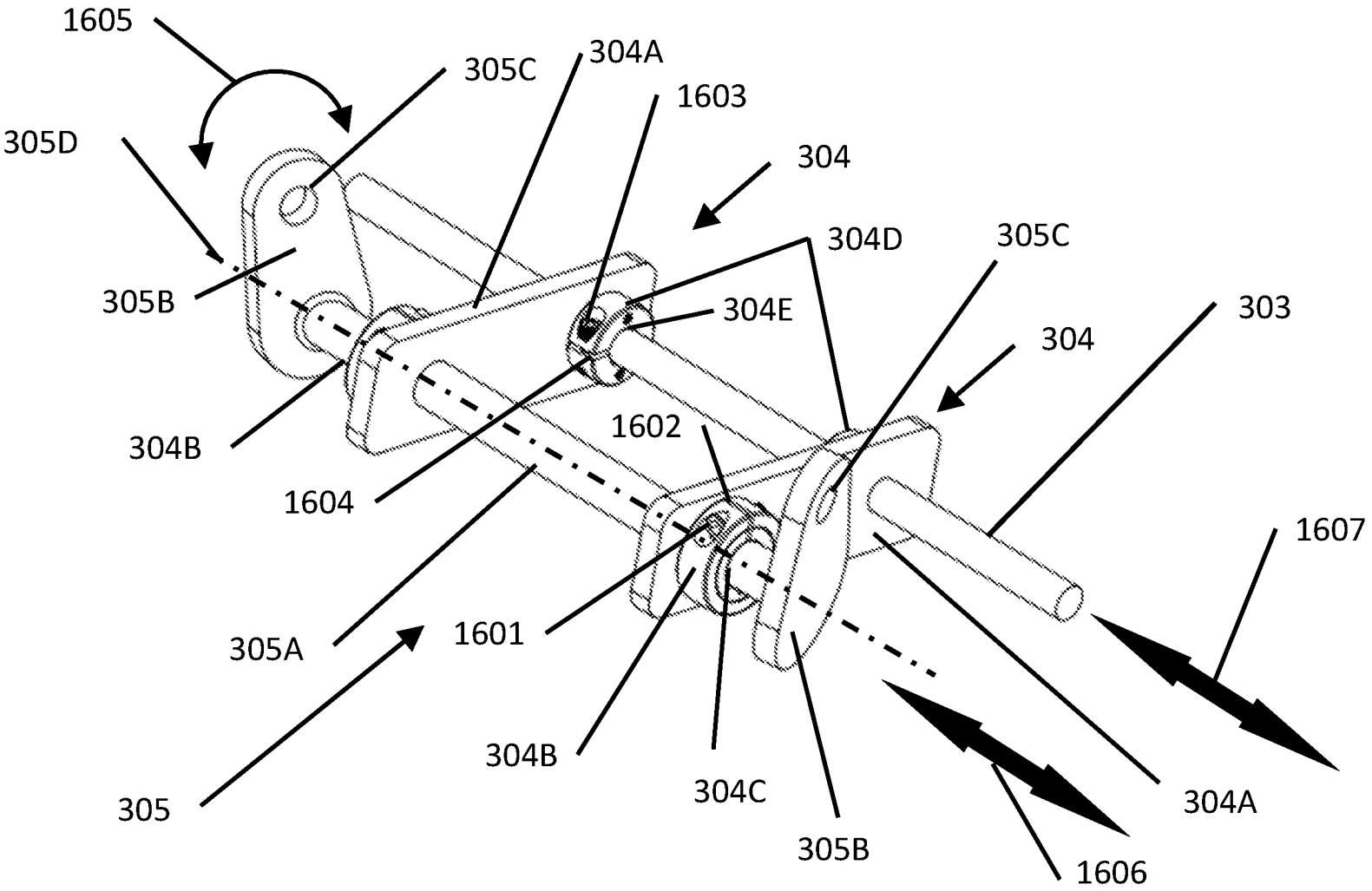
FIG. 15 depicts an isometric view of a connecting shaft, a wheel shaft, and a pair of torque arms.

FIG. 15 depicts a pair of torsion bars 304 attached to wheel shaft 303 and connecting shaft 305. In some examples torsion bars 304 may include first collar feature 304D and second collar feature 304B. First collar feature 304D may include a screw 1603 which may be tightened to compress slit 1604. Compressing slit 1604 causes the first collar surface 304E to clamp onto wheel shaft 303. Adjusting the location of wheel shaft 303 in a direction indicated by arrow 1607 is provided by loosening screw 1603 moving wheel shaft 303 along the direction indicated by arrow 1607 and tightening screw 1603. Torsion bars 304 may be adjusted relative to connecting shaft 305.

Connecting shaft 305 may be adjusted relative to torsion bars 304 in the direction indicated by arrow 1606 and rotation indicated by arrow 1605 about connecting shaft axis 305D. Adjusting the location of connecting shaft 305 in a direction indicated by arrow 1606 is provided by loosening screw 1601, moving connecting shaft 305 along the direction indicated by arrow 1606 and tightening screw 1601. Adjusting the rotational orientation of connecting shaft 305 indicated by arrow 1605 is provided by loosening screw 1601, rotating connecting shaft 305 about connecting shaft axis 305D and tightening screw 1601.

II. Dual Wheel Shaft Truck

Figure 16:
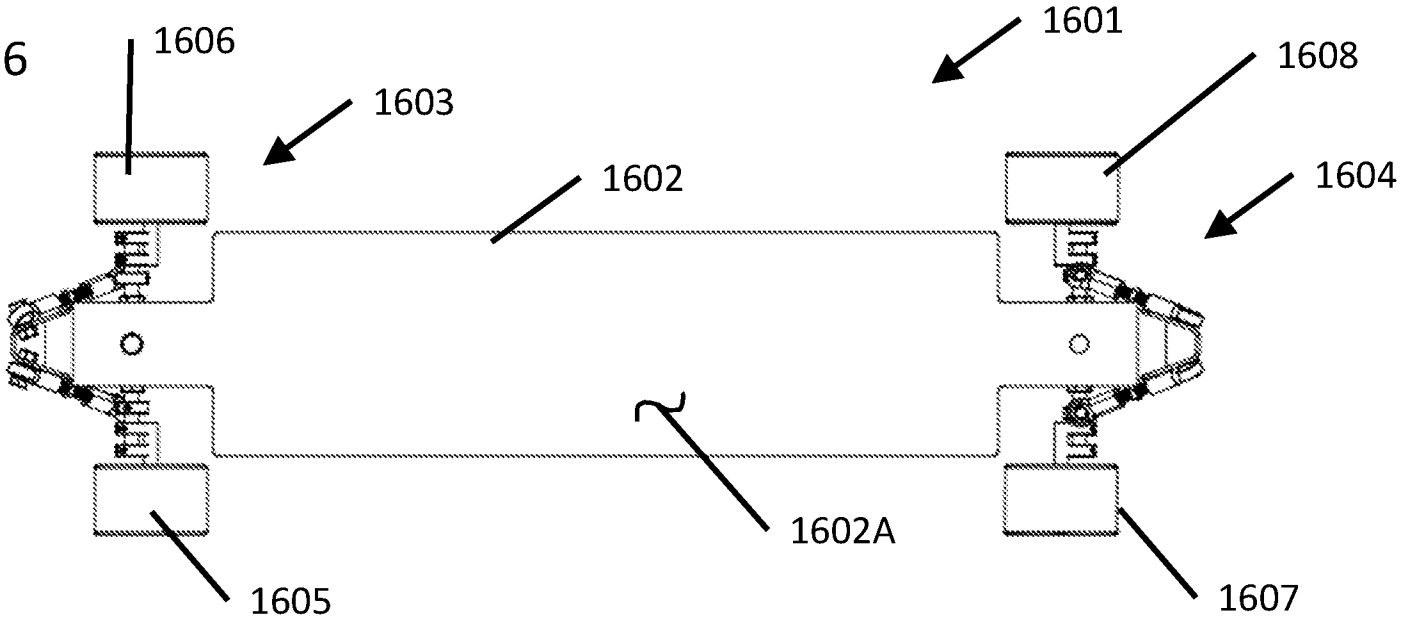
FIG. 16 depicts a top view of a skateboard with a dual wheel shaft truck.
Figure 17:
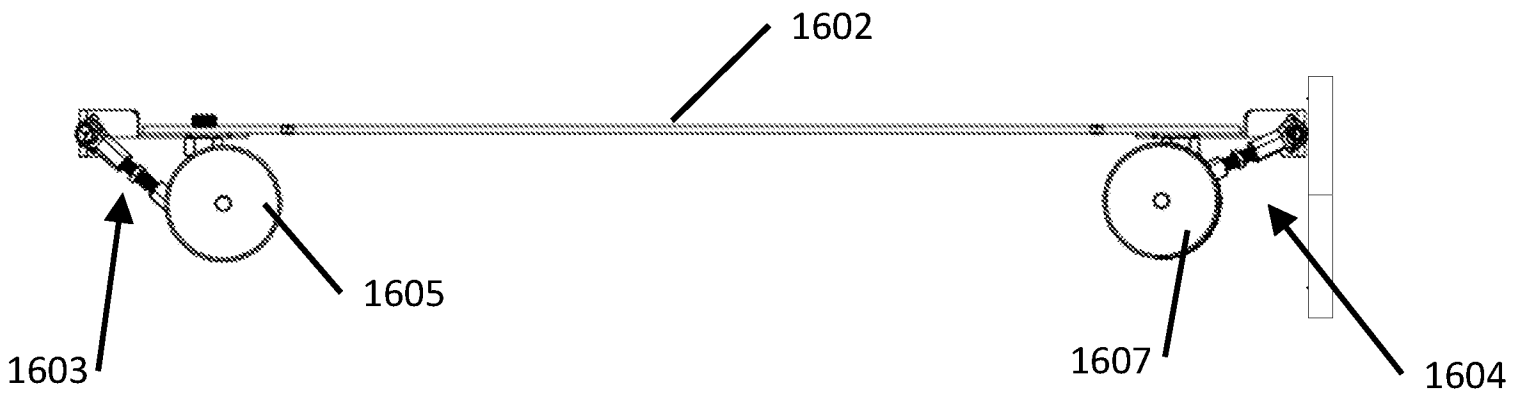
FIG. 17 depicts a side view of a skateboard with a dual wheel shaft truck.

FIGS. 16 and 17 depict a skateboard 1601 which includes board 1602, tilting skateboard truck 1603 on one end of board 1602, a second tilting skateboard truck 1604 attached on a second end of board 1602. In some examples, tilting skateboard truck 1604 may be an electrically powered skateboard truck for driving skateboard 1601. During operation the skateboard 1601 supports a user on the top surface 1602A and the skateboard 1601 is supported by wheels

1605, 1606, 1607, and 1608. Wheels 1605, and 1606 are attached to tilting skateboard truck 1603, and wheels 1607 and 1608 are attached to tilting skateboard truck 1604.

Figure 18:
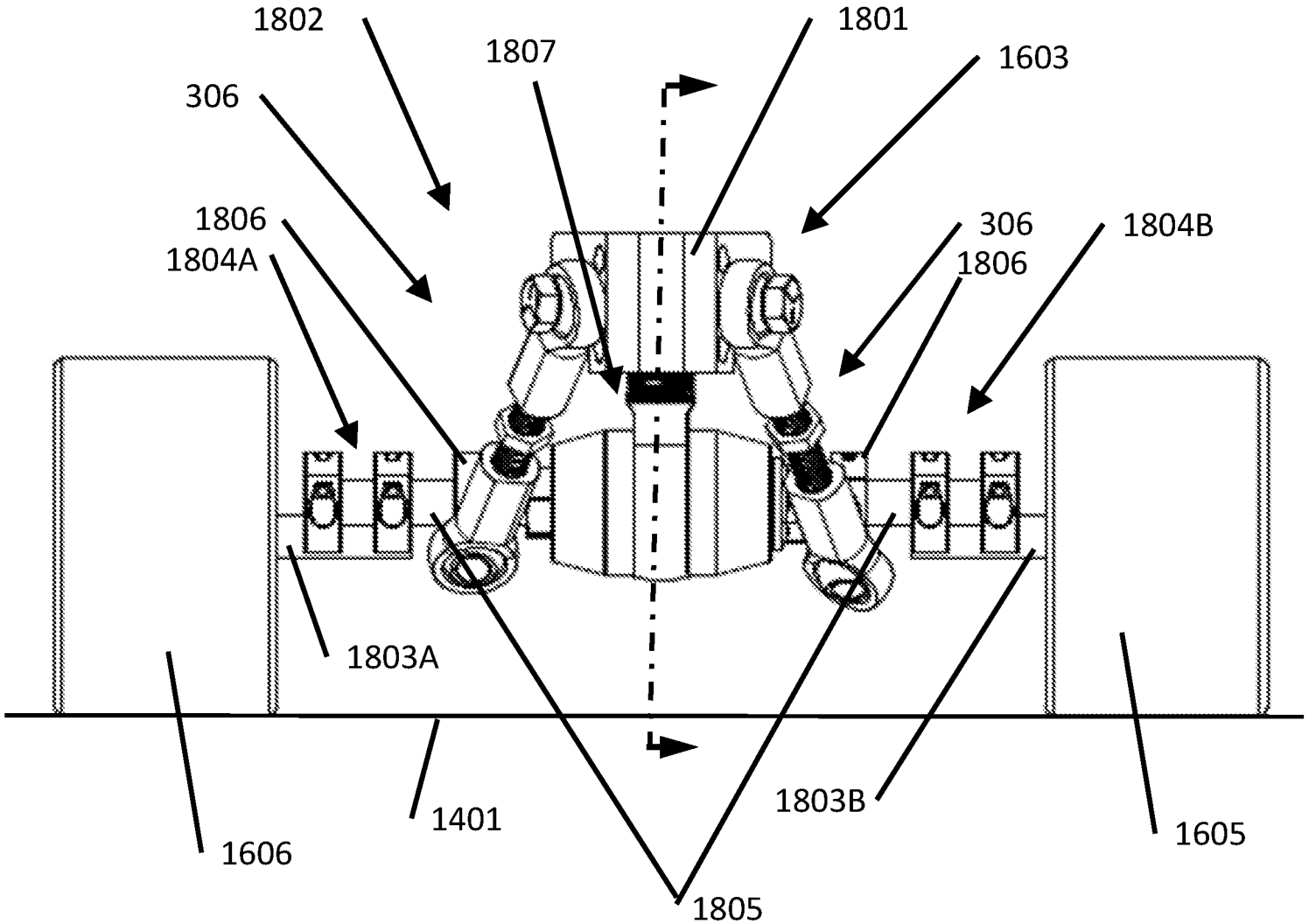
FIG. 18 depicts a front view of a dual wheel shaft truck.

FIG. 18 depicts a front view tilting skateboard truck 1603. Base 1801 supports suspension linkage 1802. Suspension linkage 1802 may support wheels 1605 and 1606 against ground 1401. Base 1801 may be attached to board 1602. Suspension linkage 1802 may be supported by base spherical bushing 1807 attached to base 1801.

Suspension linkage 1802 may include wheel shafts 1803A and 1803B, a pair of torsion bars 1804A and 1804B, connecting shaft 1805, a pair of torque arms 1806, and a pair of radius arms 306.

Wheel shafts 1803A and 1803B may be included in suspension linkage 1802 for rotationally supporting wheels 1605 and 1606. Wheel shafts 1803A and 1803B may transfer loads on wheels 1605 and 1606 to base 1801. This transference of loads is achieved through suspension linkage 1802.

Figure 19A:
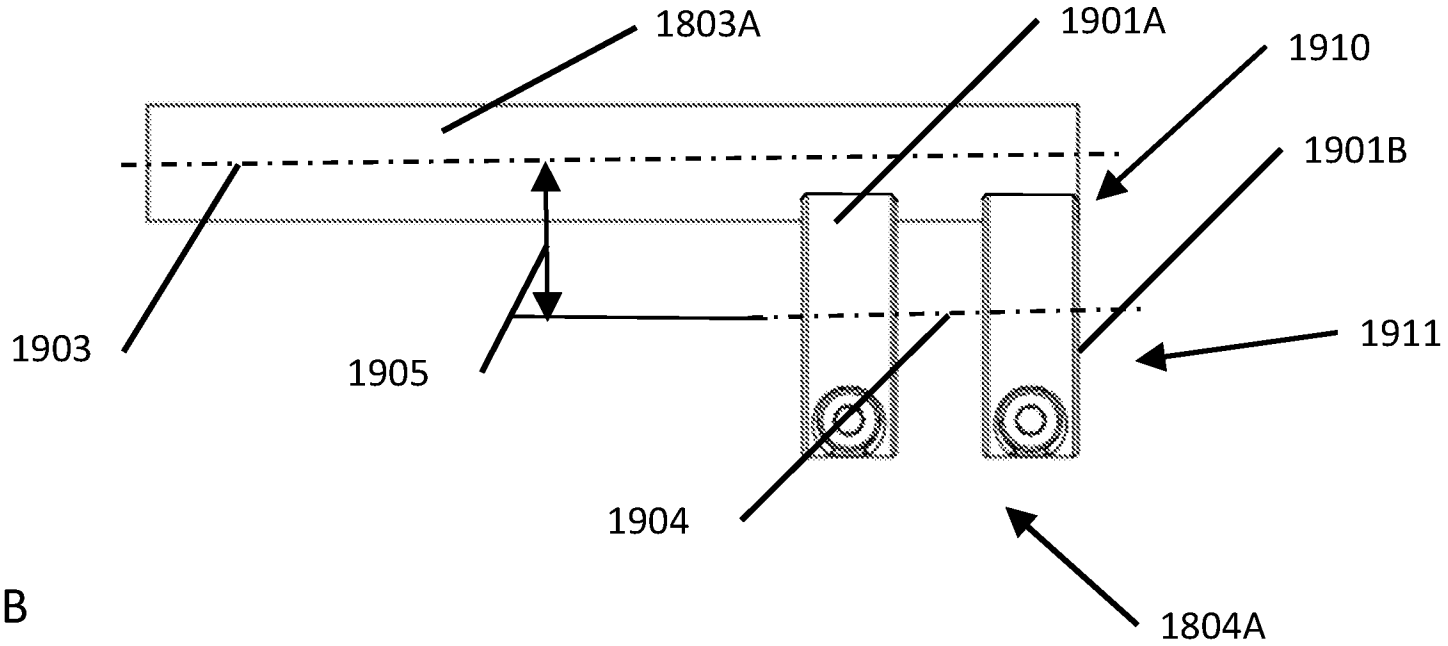
FIG. 19A depicts a top view of a torsion bar for a dual wheel shaft truck.
Figure 19B:
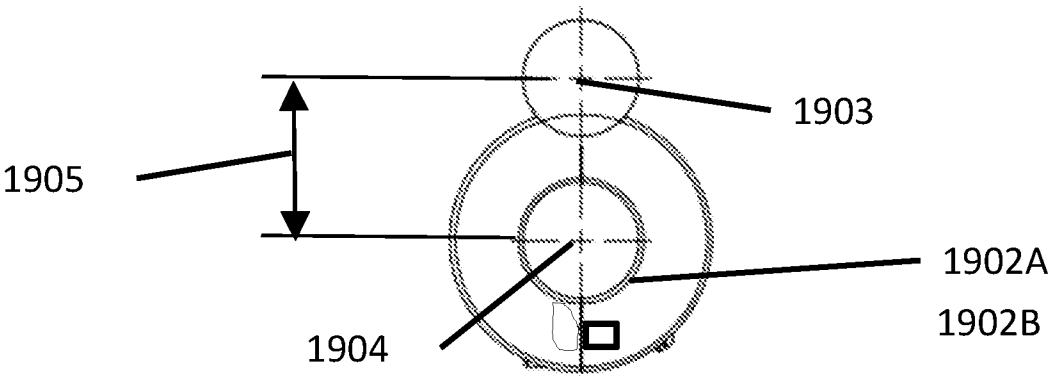
FIG. 19B depicts a side view of a torsion bar for a dual wheel shaft truck.

Torsion bar 1804A best shown in FIGS. 19A, and 19B) may include first attachment feature 1910 for attachment to wheel shaft 1803A. The first attachment feature 1910 may be welded, brazed, glued, or screwed to wheel shaft 1803A. Torsion bars 1804A and 1804B may include a second attachment feature 1911 for rigidly attaching to connecting shaft 1805. In some examples a second attachment feature 1911 may be a pair of collar features 1901A and 1901B. Torsion bars 1804A and 1804B may be rigidly attached to connecting shaft 1805 by collar features 1901A and 1901B on collar surfaces 1902A and 1902B. Wheel shaft 1803A may include wheel shaft axis 1903 and collar features 1901A and 1901B may include a collar axis 1904. Wheel shaft axis 1903 and collar axis 1904 may be disposed at torsion bar distance 1905. Torsion bar distance 1905 provides for transmitting torque from wheel shaft 1803A to collar features 1901A and 1901B. With collar features 1901A and 1901B rigidly attached to connecting shaft 1805 torque may be transferred from wheel shaft 1803A to connection shaft 1805.

Radius arms 306 support torque arms 1806 which in turn are supported on base 1801. FIG. 5 depicts a radius arm 306 which may include several features. Radius arm 306 may include a length adjustment device 700. In some examples, length adjustment device 700 may include a left-hand rod end 701, a right-hand rod end 702 and a length adjust screw 705. Left hand rod end 701 and right-hand rod end 702 may include spherical bushings 703 and 704 respectively. Spherical bushings 703 and 704 provide rotation about a single point and so are allowed to pivot to align with bolts in mounting holes. The left-hand rod end 701 may include left hand threads for engagement with left hand external threads 705A on length adjust screw 705. Right hand rod end 702 may include right hand threads for engagement with right hand external threads 705B. By rotating length adjust screw 705 relative to the left-hand rod end 701 and right-hand rod end 702 the rod ends move toward or away from each other. Turn feature 705C may be included on length adjust screw 705. Therefore, the length of the radius arms 306 may be adjusted. In some examples, length adjustment device 700 may be constructed using shafts and clamps, wedges, and other means. Any device which can adjust the radius arm length may act as length adjustment device 700 and satisfy this disclosure.

Additionally, the length adjustment device 700 may include internal left-hand and right-hand threads as part of the length adjust screw 705 and left hand rod end 701 may include external left-hand threads and right-hand rod end 702 may include external right-hand threads. The disclosure example only needs to allow for length adjustment of radius arm 306.

Figure 20B:
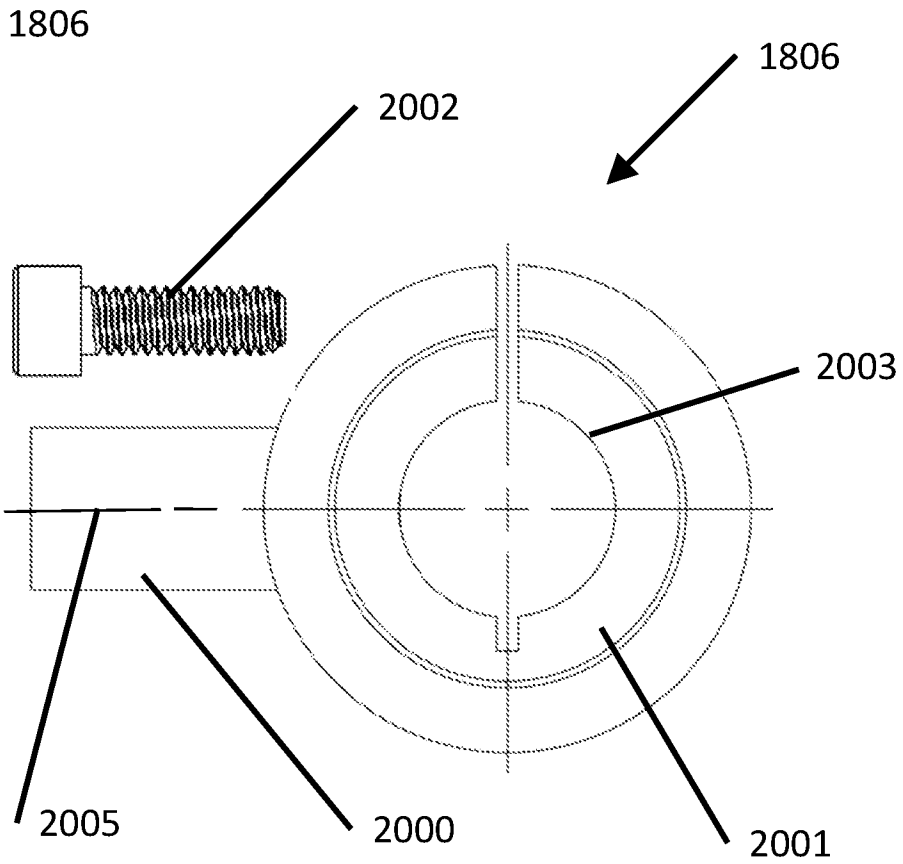
FIG. 20B depicts a side view of a torque arm for a dual wheel shaft truck.
Figure 20A:
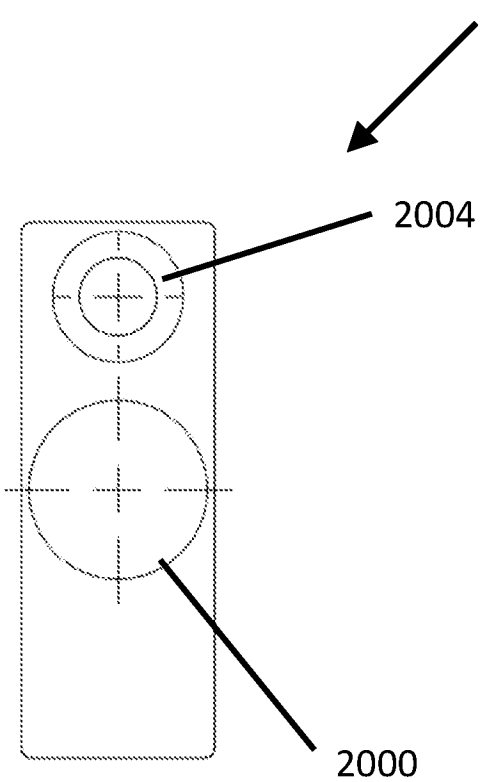
FIG. 20A depicts a front view of a torque arm for a dual wheel shaft truck.

FIGS. 20A, and 20B depict torque arm 1806. Torque arm 1806 may include clamp ring 2001, clamp screw 2002, radius arm attachment feature 2000, torque arm axis 2005, and clamp ring clamping surface 2003. The connecting shaft 1805 may be inserted into clamp ring 2001 and clamped in place by inserting clamp screw 2002 into clamp hole 2004 and tightening clamp screw 2002. Tightening clamp screw 2002 causes clamping surface 2003 to deflect radially and clamp the connecting shaft 1805 in place. The radius arm mount feature 2000 is configured to rigidly attach spherical bushing 703 (for example) to torque arm 1806. This rigid attachment may be a press fit, a screw, a rivet or any other means that results in the spherical bushing 703 being rigidly attached to the torque arm 1806 at mount feature 2000.

Figure 21:
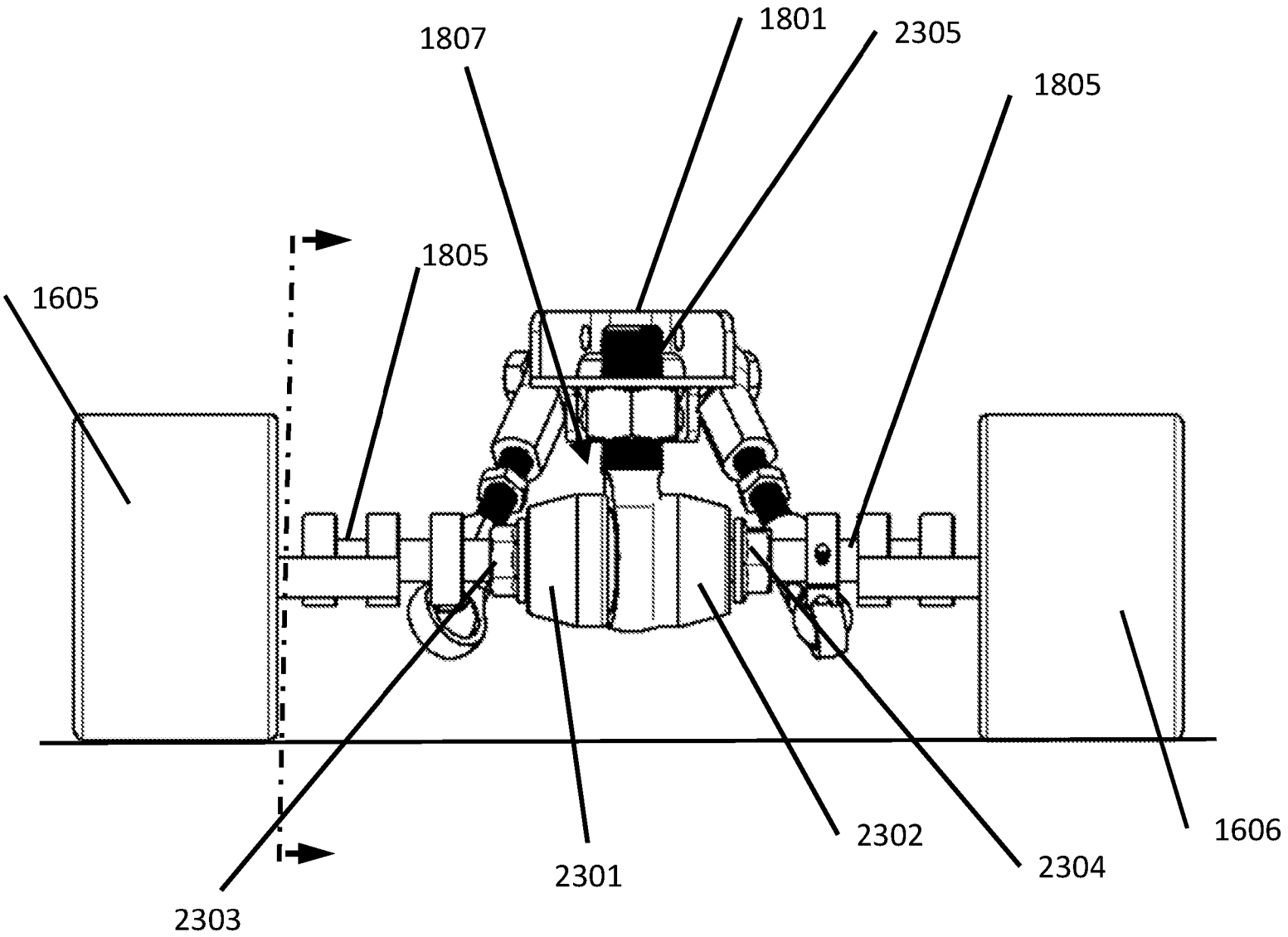
FIG. 21 depicts a rear view of a dual wheel shaft truck.

FIG. 21 depicts connecting shaft 1805 supported by base spherical bushing 1807 attached to base 1801. The base spherical bushing 1807 may be rigidly connected to connecting shaft 1805 and allow for rotation about a point. Connecting shaft 1805 may support elastic bushings 2301 and 2302 disposed adjacent to base spherical bushing 1807. Elastic bushings 2301 and 2302 are supported along connecting shaft 1805 by nuts 2303 and 2304 respectively. Elastic bushings 2301 and 2302 may be preloaded against the base spherical bushing 1807.

Figure 22:
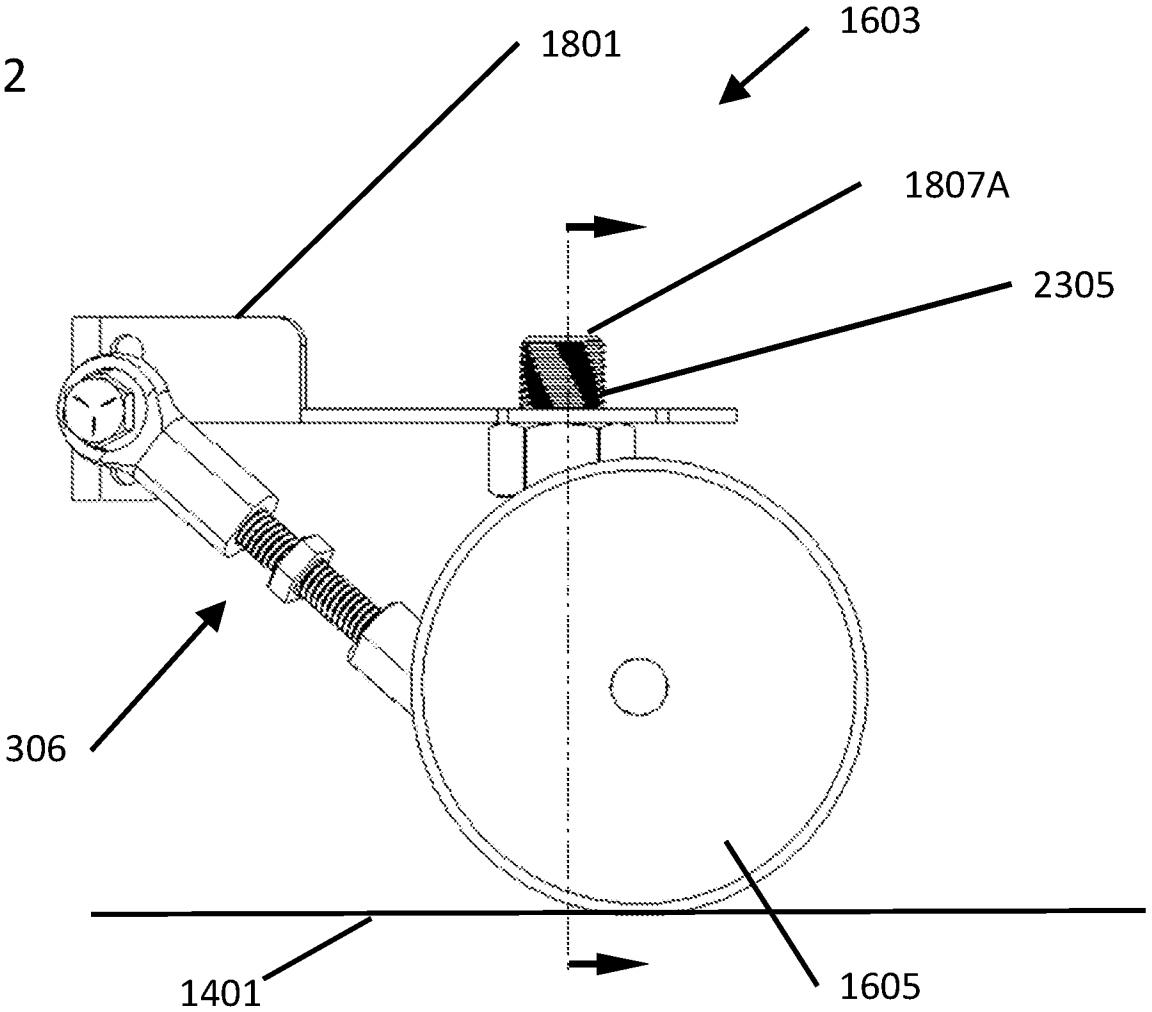
FIG. 22 depicts a sided view of a dual wheel shaft truck.
Figure 23:
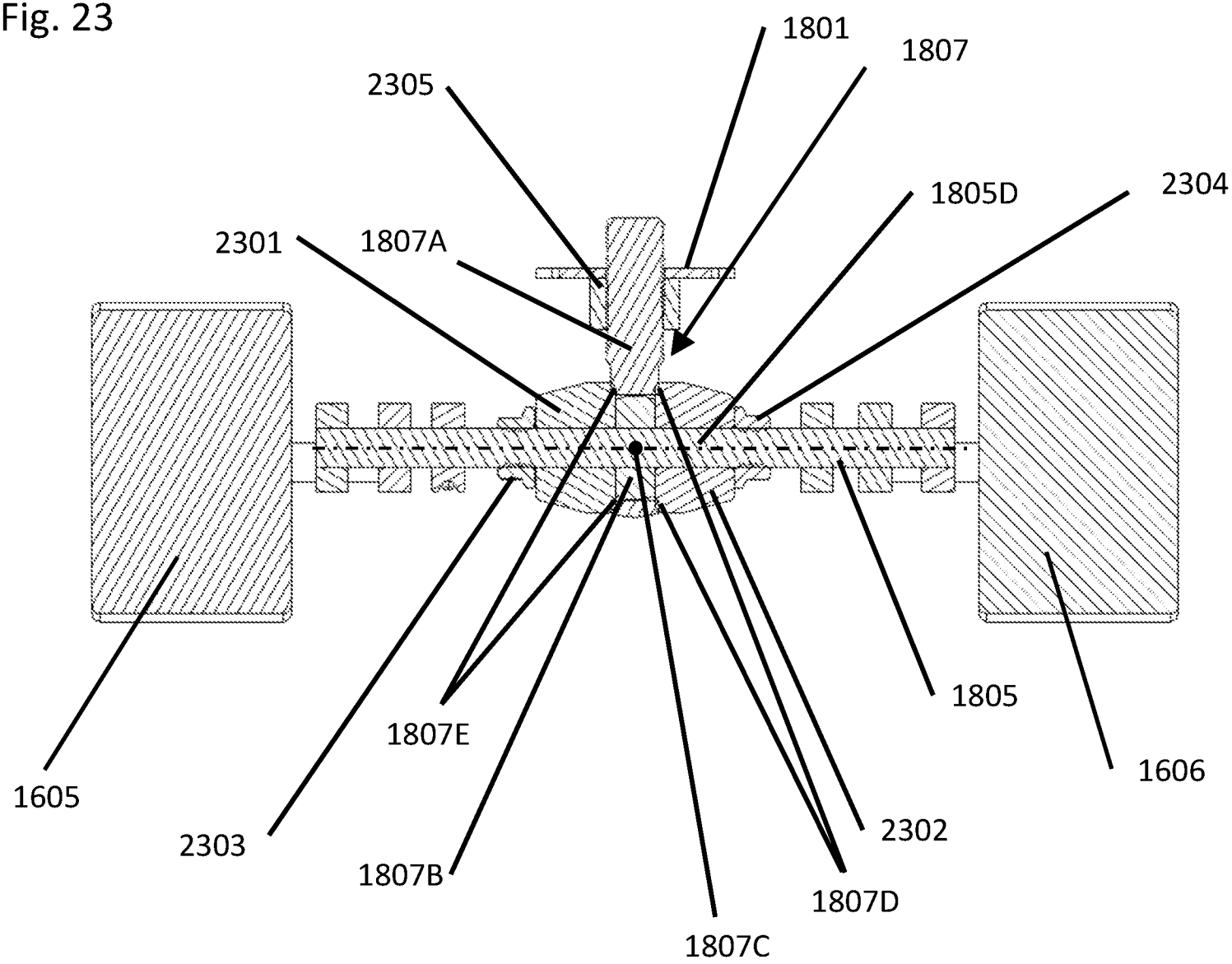
FIG. 23 depicts the section view indicated in FIG. 22.

FIG. 22 depicts a side view of tilting skateboard truck 1603 and indicates the location of cross section view depicted in FIG. 23. Referring to FIG. 23, the connecting shaft 1805 is supported by base spherical bushing 1807. Base spherical bushing 1807 may include a spherical insert 1807B that is supported by spherical base 1807A. Spherical insert 1807B is supported such that rotation about rotation point 1807C may occur in any direction. Rotation point 1807C is held in a fixed location along connecting shaft axis 1805D. The spherical insert 1807B is also held in a fixed location by the spherical base 1807A relative to base 1801. This allows the radius arms 306 to push and pull connecting shaft 1805 about rotation point 1807C. The applicant has found that vertical loads on wheels 1805 and 1806 transferred through suspension linkage 1802 to base 1801 causes a response when base 1801 is tilted that helps return the base 1801 to level. Connection shaft 1805 may also be supported by base spherical bushing 1807 and elastic bushings 2301 and 2302.

Elastic bushing 2302 may be preloaded against spherical bushing side 1807D and elastic bushing 2301 may be preloaded against spherical bushing side 1807E. Elastic bushing preload nut 2303 may be threadedly attached to connection shaft 1805. Tightening elastic bushing preload nut 2303 causes elastic bushing 2301 to be pressed against spherical bushing side 1807E. Elastic preload bushing nut 2304 may be threadedly attached to connection shaft 1805. Tightening elastic bushing preload nut 2304 causes elastic bushing 2302 to be pressed against spherical bushing side 1807D. Pressing elastic bushing 2301 and 2302 against spherical bushing sides 2307E and 2307D causes resistance to rotation of connecting shaft 1805 about rotation point 1807C. Elastic bushings 2301 and 2302 provide a leveling response through suspension linkage 1802 to the base 1801.

Figure 24:
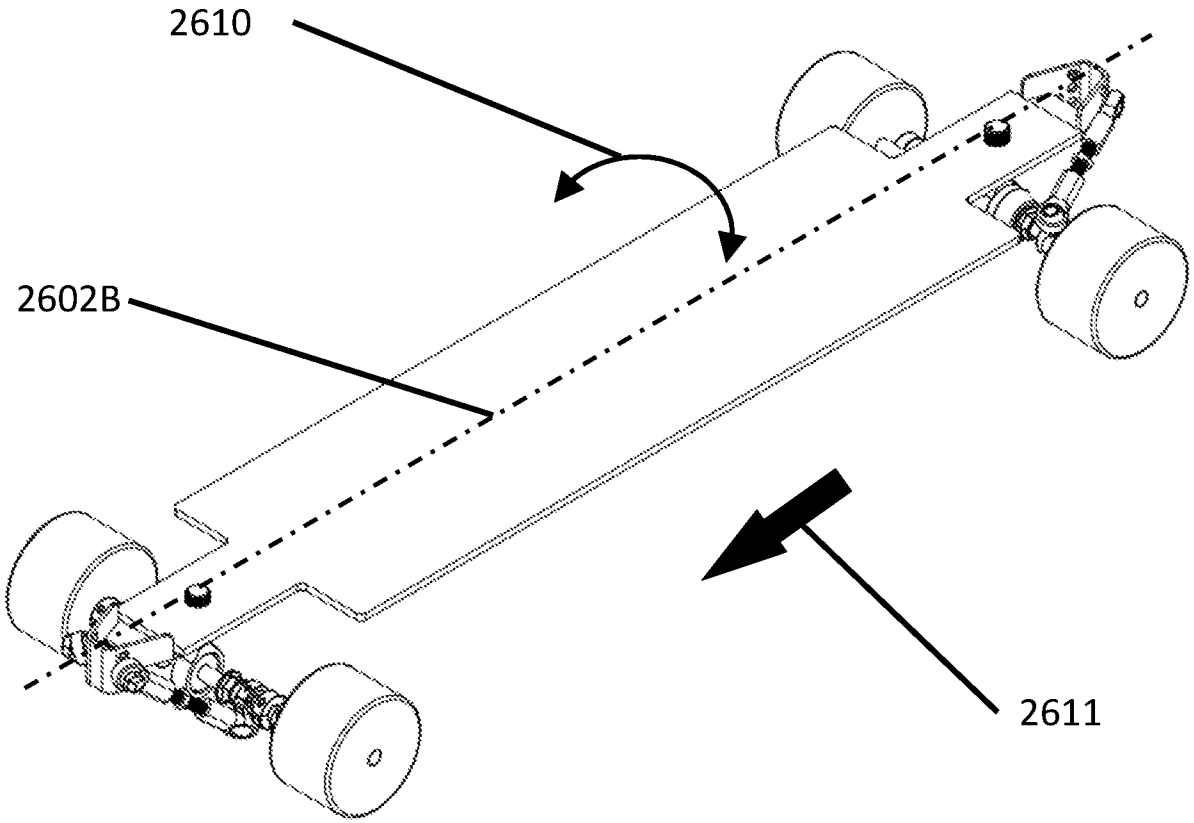
FIG. 24 depicts an isometric view of a skateboard with dual wheel shaft trucks.
Figure 25:
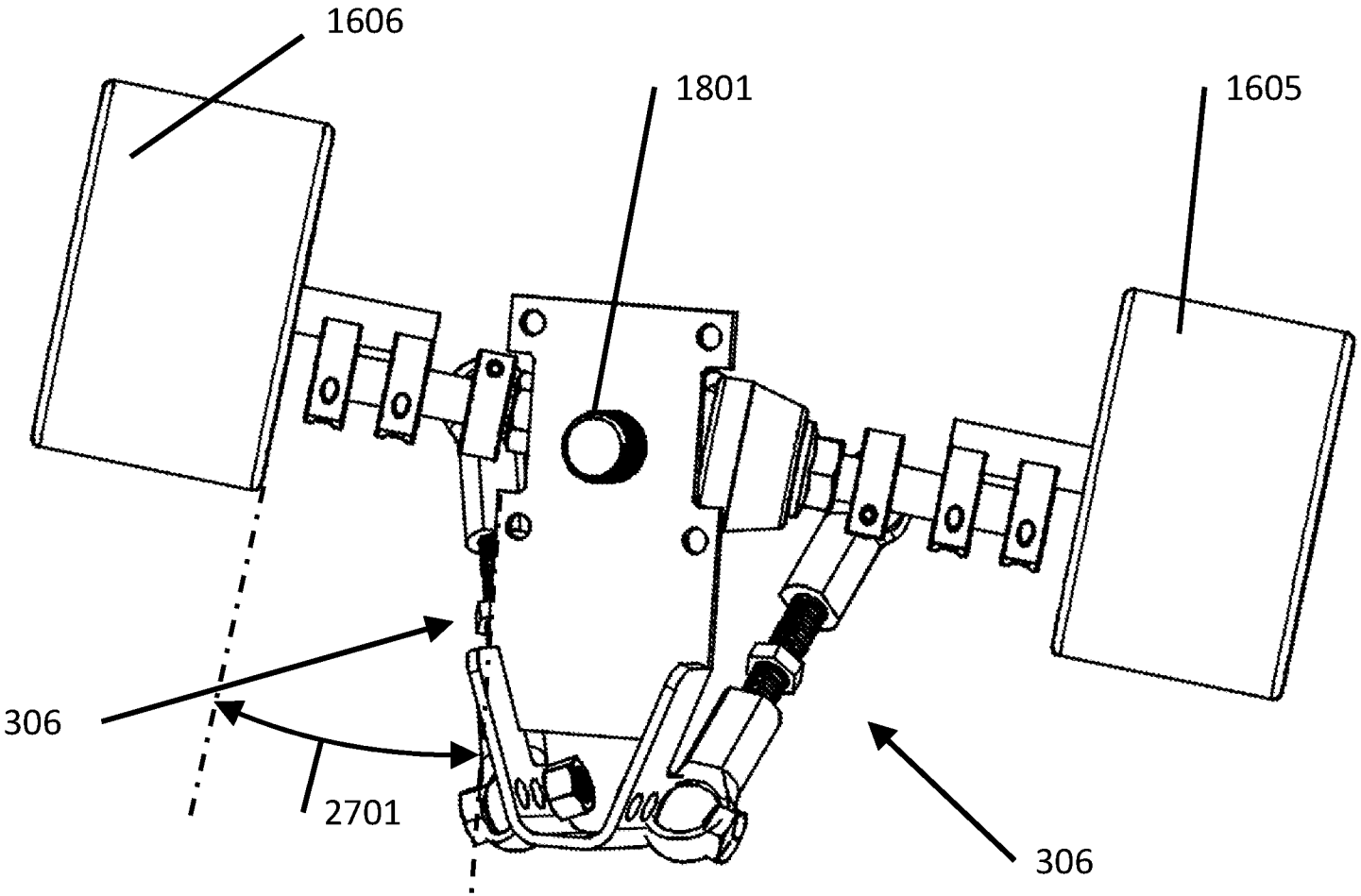
FIG. 25 depicts a top view of a dual wheel shaft truck in a turning orientation.

During use board 1602 may be tilted about board axis 2602B (best seen in FIG. 24) indicated by tilt arrow 2610. Additionally, a typical direction of travel is in the direction indicated by arrow 2611. Suspension linkage 1802 turns wheels 1605 and 1606 as board 1602 is tilted about board axis 2602B. This is shown best in FIG. 25. Base 1801 is tilted in this top view and wheels 1605 and 1606 turn at angle indicated by arrow 2701. This causes the direction of travel to change. The angle of radius arms 306 may determine the steering ratio. The steering ratio is the angle of tilt of board 1602 to the size of angle 2701. As the radius arms 306 are angled relative to horizontal the steering ratio is increased and as radius arms 306 are moved to a more horizontal orientation the steering ratio is decreased. The steering ratio affects the response of the skateboard 1601 and increases control for the user. The steering ratio also determines the stability of tilting truck 1603 when going straight.

The applicant has also found that radius arms 306 may be loaded against connecting shaft 1805 and base 1801 such that a return to level response is established. This is generally a result of radius arms 306 located above torque bar 1804A and translation of a vertical force on wheels 1805 and 1806 to base 1801 using suspension linkage 1802. Suspension linkage 1802 may also use bushings 2301 and 2302 to establish a return to level response.

Figure 26:
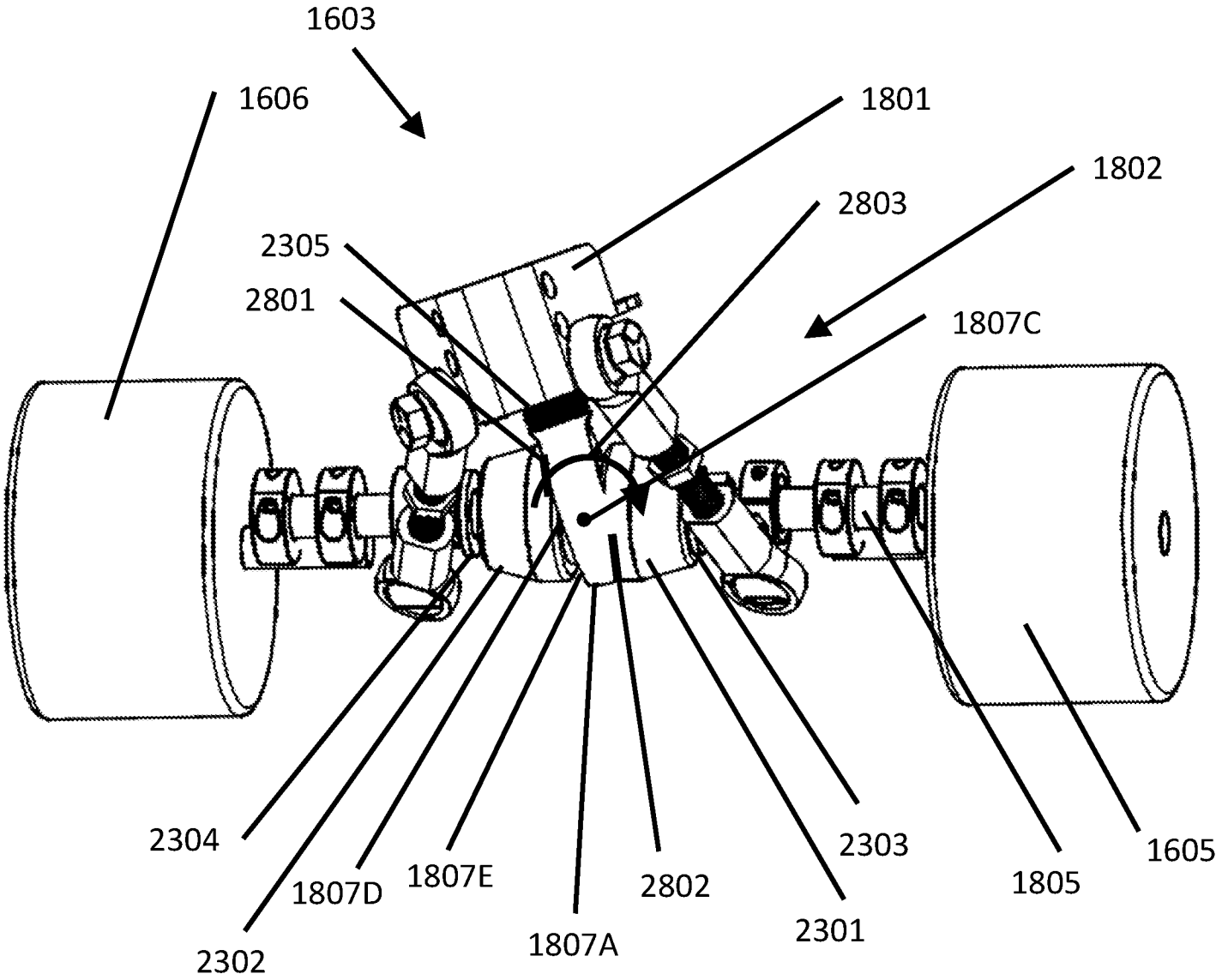
FIG. 26 depicts a front view of a dual wheel shaft truck in a turning orientation.

FIG. 26 depicts tilting truck 1603 in a tilted orientation. As a result of positioning elastic bushings 2301 and 2302 against spherical bushing side 1807D and spherical bushing side 1807E of spherical bushing base 1807A compression zones 2801 and 2802 develop when base 1801 is tilted. Compression zones 2801 and 2802 cause torque indicated by arrow 2803 to act on spherical bushing body 1807A and connecting shaft 1805. This torque acts on base 1801 and causes base 1801 to resist tilting and causes a return to level response.

Figure 27B:
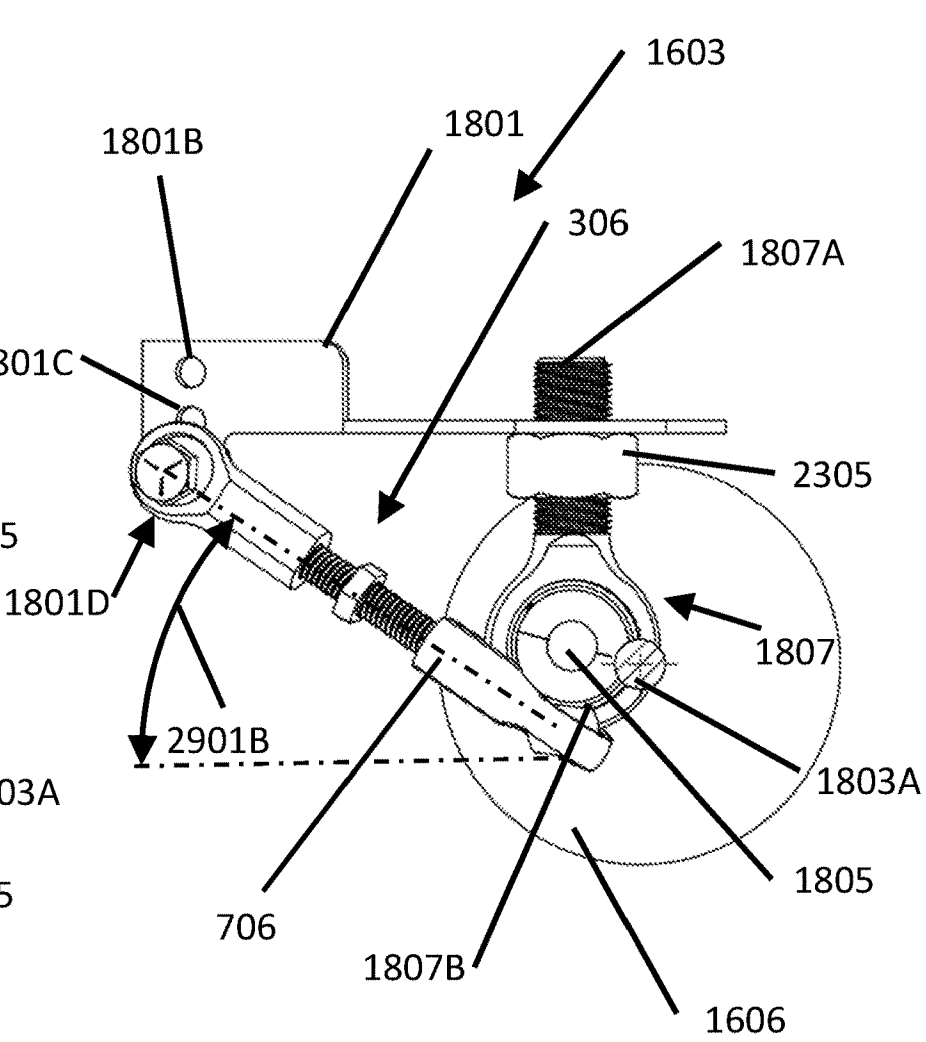
FIG. 27B depicts a cross-section view indicated in FIG. 21 with radius arms attached to the base at a small angle.
Figure 27A:
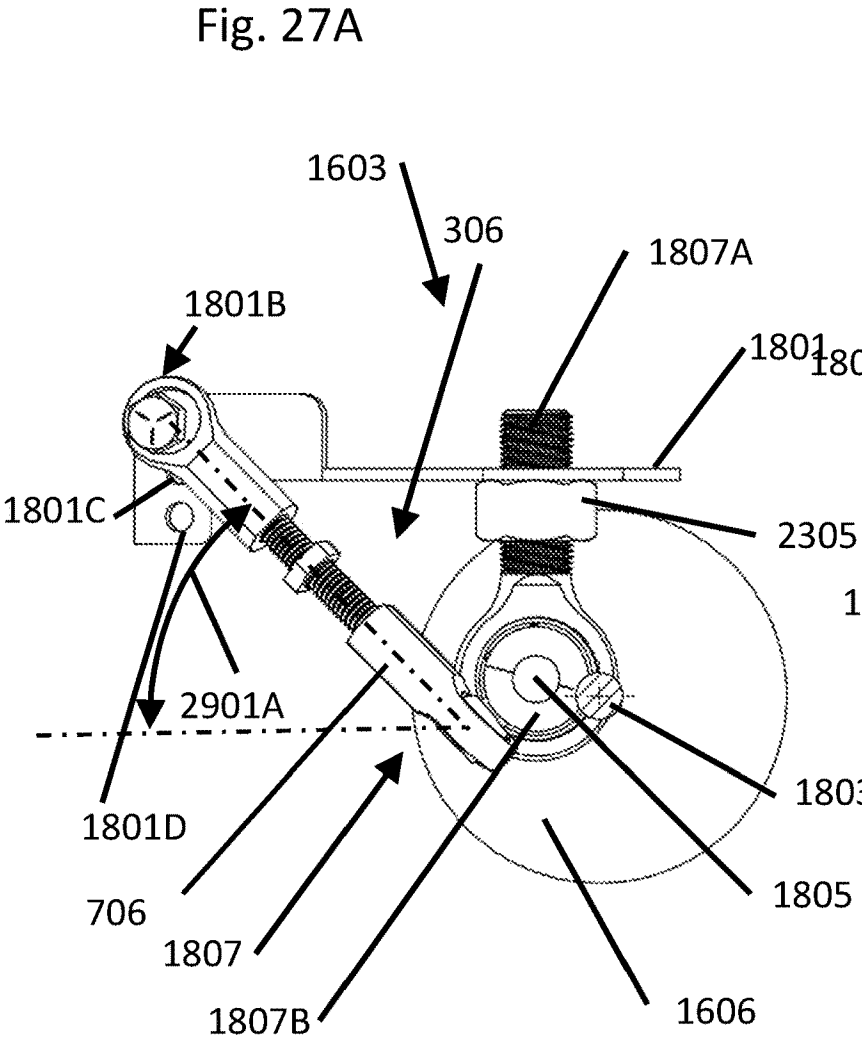
FIG. 27A depicts a cross-section view indicated in FIG. 21 with radius arms attached to the base at a large angle.

Radius arms 306 may also be adjusted to change the steering ratio. In some examples, radius arms 306 may be attached to base 1801 in different locations such as at first attachment feature 1801B, second attachment feature 1801C, and third attachment feature 1801D (best shown in FIGS. 27A and 27B). FIGS. 27A and 27B depict tilting truck 1603 using first attachment feature 1801B and third attachment feature 1801D. The steering ratio of tilting skateboard truck 1603 is adjusted by changing radius arm angle 2901A shown in FIG. 27A to angle 2901B shown in FIG. 29B. Larger radius arm angle 2901A (shown in FIG. 27A) results in a larger steering ratio and smaller radius arm angle 2901B (shown in FIG. 27B) results in a smaller steering ratio. In FIG. 27A radius arm 306 is attached to base 1801 at first attachment feature 1801B this causes radius arm 306 to be supported at angle 2901A. In FIG. 27B radius arm 306 is attached to base 1801 at third attachment feature 1801D this causes radius arm 306 to be supported at angle 2901B. Angle 2901A is larger than angle 2901B and angle 2901A provides a larger steering ratio. Suspension linkage 1802 may include radius arm 306 length adjustment.

Figure 28B:
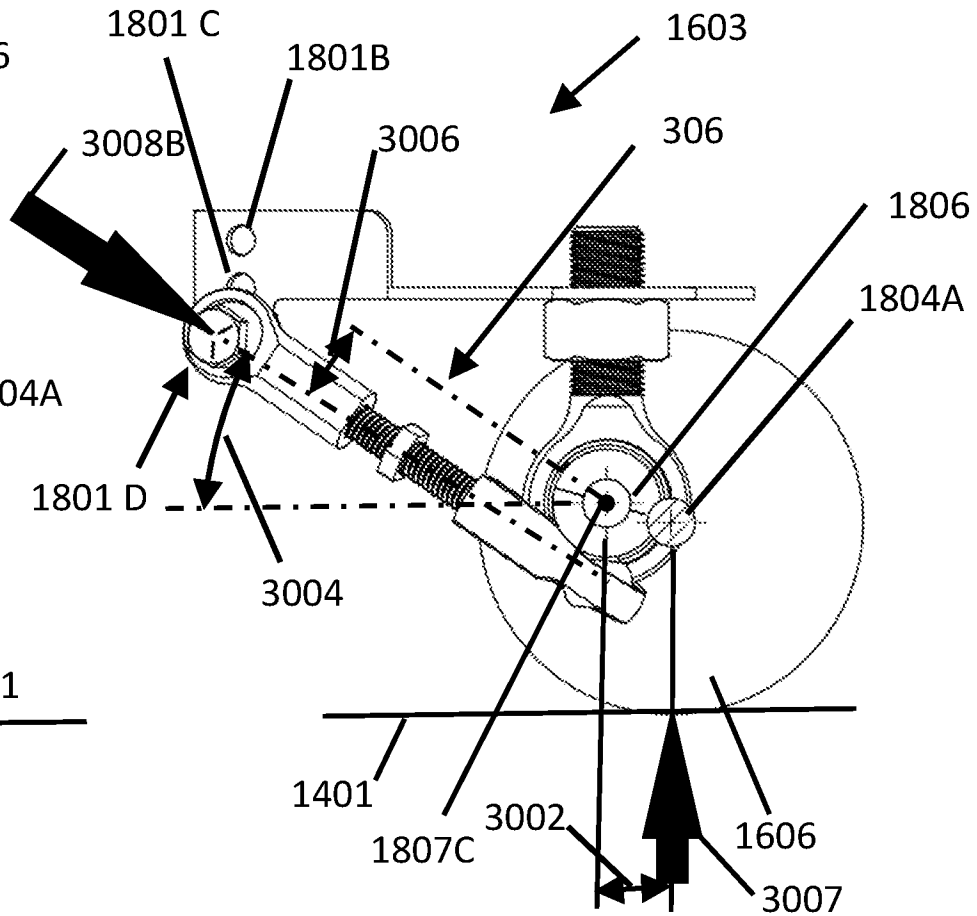
FIG. 28B depicts a cross-section view indicated in FIG. 21 with radius arms attached to the base at a small angle and showing forces acting on the truck.
Figure 28A:
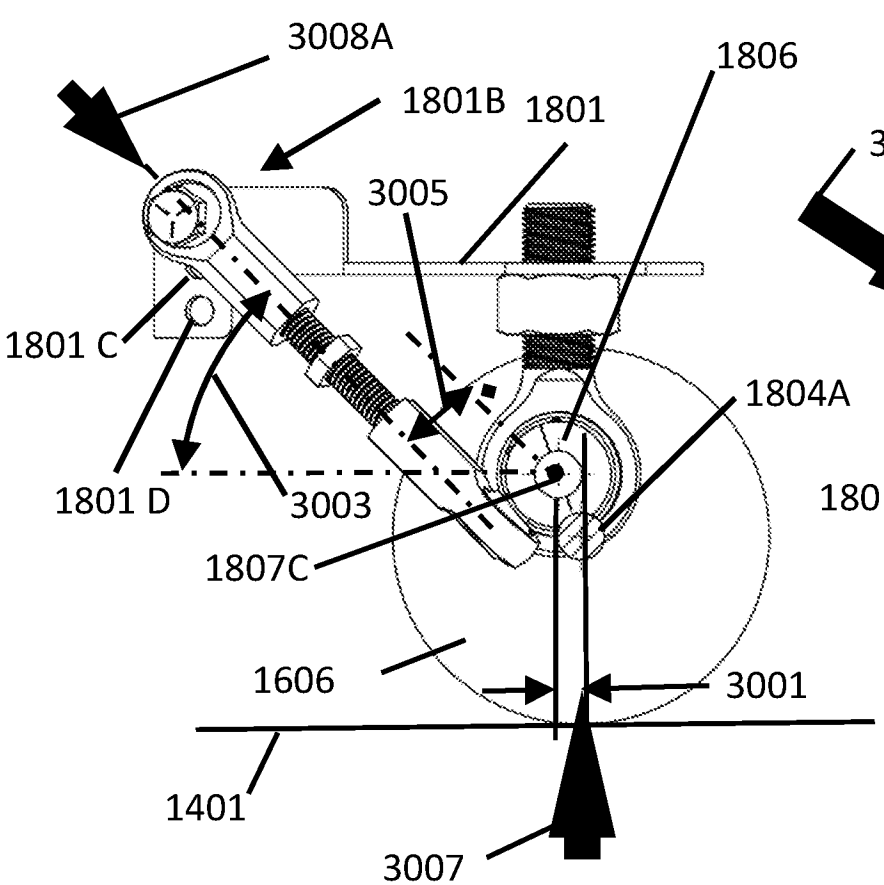
FIG. 28A depicts a cross-section view indicated in FIG. 21 with radius arms attached to the base at a large angle and showing forces acting on the truck.

Radius arms 306 may also be adjusted to affect the response to wheel forces. In some examples, radius arms 306 may be attached to base 301 in different locations such as at first attachment feature 1801B, second attachment feature 1801C, and third attachment feature 1801D. FIGS. 28A and 28B depict tilting skateboard truck 1603 using first attachment feature 1801B and third attachment feature 1801D. In FIG. 28A radius arm 306 is attached to base 1801 at first attachment feature 1801B. In some examples, wheel shaft 1804A rotate with torque arm 1806 which supports an end of radius arm 306. This positions radius arm 306 at a first angle 3003 and radius arm 306 is positioned to have a first lever arm of distance 3005. Wheel shaft 1804A having a wheel lever arm of distance 3001 about rotation point 1807C for supporting wheel force 3007. In FIG. 28B radius arm 306 is attached to base 1801 at third attachment feature 1801D. In some examples, wheel shaft 1804A rotates with torque arm 1806 which supports an end of radius arm 306. This positions radius arm 306 at a second angle 3004 and radius arm 306 is positioned to have a second lever arm of distance 3006. Wheel shaft 1804A has a wheel lever arm of distance 3002 about rotation point 1807C for supporting wheel force 3007. While first lever arm distance 3005 and second lever arm distance 3006 remain equal, wheel arm distance 3001 is smaller than wheel arm distance 3002. It is well understood in the art that for a given force 3007 applied by an operator forces 3008A and 3008B acting along radius arm 306 will differ. The tilting skateboard truck 1603 responses to the operator differently adjusted in FIG. 28A than when adjusted as in FIG. 28B. The height of rotation point 1807C may also be adjusted.

Figure 30:
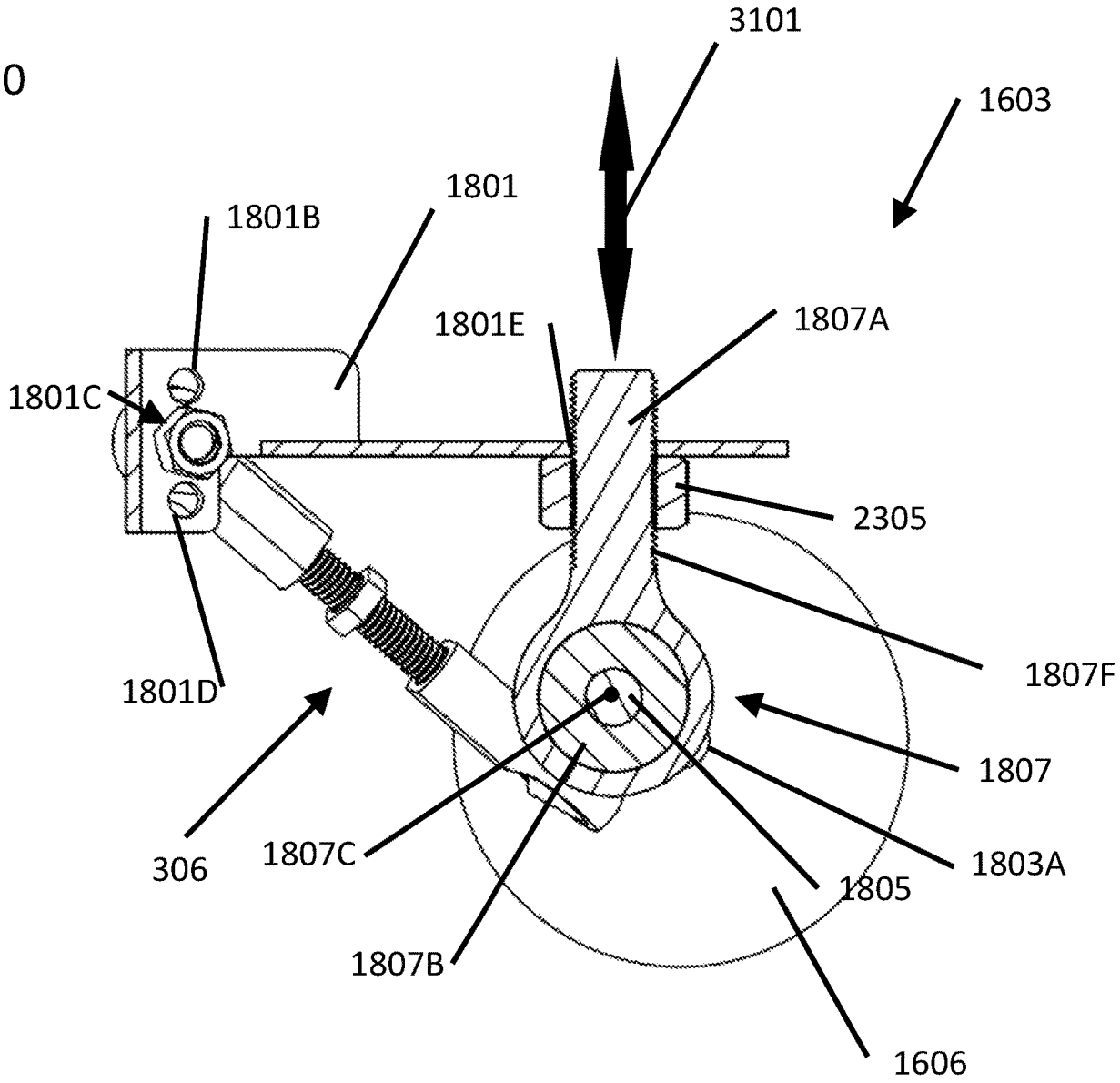
FIG. 30 depicts the cross-section view indicated in FIG. 18.

Rotation point 1807C is shown in FIG. 30 and is located at the center of spherical insert 1807B and is also coincident with the connecting shaft axis 1805D. Spherical bushing body 1807A may include external threads 1807F which may be screwed into base 1801 at spherical bushing attach threaded hole 1801E. Nut 2305 may be used to fix spherical bushing body 1807A in place by tightening nut 2305 against base 1801. Adjusting the height of rotation point 1807C upward or downward as indicated by arrow 3101 may be accomplished by rotating spherical bushing base 1807A relative to base 1801 then fixing it in place by tightening nut 2305 against base 1801. Adjusting the location of rotation point 1807C may provide desirable effects of tilting skateboard truck 1603. Torsion bars 1806 may be adjusted also.

Figure 31:
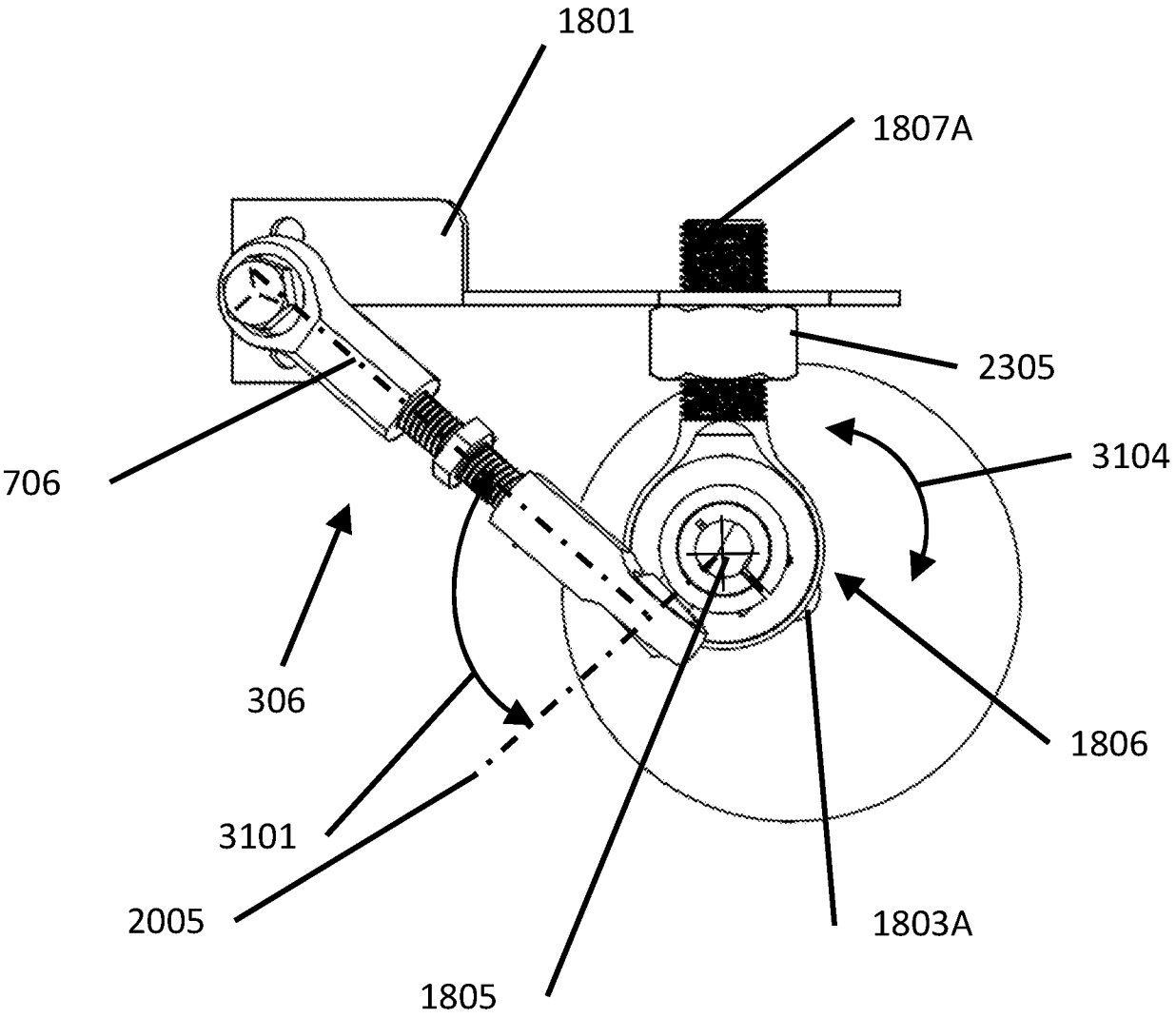
FIG. 31 depicts the cross-section view indicated in FIG. 21.

FIG. 31 depicts torsion arm 1806 adjusted such that leverage angle 3101 is a right angle (i.e. 90 degrees). The leverage angle 3101 is the angle between the radius arm axis 706 and the torsion arm axis 2005. The applicant has found that maintaining this right angle may be beneficial for performance reasons. To maintain the leverage angle 3101 at a right angle, torsion arm 1806 may be rotated about connecting shaft 1805 as indicated by arrow 3104. Loosening clamping screw 2002 (best seen in FIGS. 20A and 20B) such that clamping surface 2003 unclamps connecting shaft 1805 allows the torsion arm 1806 to be rotated about connecting shaft 1805. Tightening clamping screw 2002 moves clamping surface 2003 and clamps the torsion arm 1806 to the connecting shaft 1805.

Advantages, Features, and Benefits

The examples of the skateboard truck described herein provide several advantages over known skateboard trucks. For example, illustrative examples described herein provide a return to level response during tilting of the skateboard. A return to level response increases safety and allows an operator additional control.

Additionally, the tilting skateboard truck described herein includes several adjustments. For example, radius arm angle may be adjusted to provide the operator with a desirable steering ratio. The steering ratio determines how straight and self correcting the tilting skateboard truck will be.

Additionally, the elastic bushings may be preloaded to a desirable amount. This preloading may be used to increase or decrease the return to level response during tilting.

Additionally, the torque arms are adjustable to provide a more desirable position and orientation. This includes allowing the operator to adjust the suspension linkage as needed.

Additionally, the height of the board relative to the ground can be adjusted by adjusting the spherical bushing. This may be desirable for terrain clearance as well as tilting clearance of the suspension linkage relative to the board.

Conclusion

The corresponding structures, materials, acts, and equivalents of all means or step plus function elements in the claims below are intended to include any structure, material, or act for performing the function in combination with other claimed elements as specifically claimed. The description of the present technology has been presented for purposes of illustration and description but is not intended to be exhaustive or limited to the present technology in the form disclosed. Many modifications and variations will be apparent to those of ordinary skill in the art without departing from the scope and spirit of the present technology. Exemplary examples were chosen and described in order to best explain the principles of the present technology and its practical application, and to enable others of ordinary skill in the art to understand the present technology for various examples with various modifications as are suited to the particular use contemplated.

In the above description, for purposes of explanation and not limitation, specific details are set forth, such as particular examples, procedures, techniques, etc. in order to provide a thorough understanding of the present invention. However, it will be apparent to one skilled in the art that the present invention may be practiced in other examples that depart from these specific details.

Reference throughout this specification to "one example" or "an example" means that a particular feature, structure, or characteristic described in connection with the examples is included in at least one example of the present invention. Thus, the appearances of the phrases "in one example" or "in an example" or "according to one example" (or other phrases having similar import) at various places throughout this specification are not necessarily all referring to the same examples. Furthermore, the particular features, structures, or characteristics may be combined in any suitable manner in one or more examples. Furthermore, depending on the context of discussion herein, a singular term may include its plural forms and a plural term may include its singular form.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. If any disclosures are incorporated herein by reference and such incorporated disclosures conflict in part and/or in whole with the present disclosure, then to the extent of conflict, and/or broader disclosure, and/or broader definition of terms, the present disclosure controls. If such incorporated disclosures conflict in part and/or in whole with one another, then to the extent of conflict, the later-dated disclosure controls.

While various embodiments have been described above, it should be understood that they have been presented by way of example only, and not limitation. The descriptions are not intended to limit the scope of the invention to the particular forms set forth herein. To the contrary, the present descriptions are intended to cover such alternatives, modifications, and equivalents as may be included within the spirit and scope of the invention as defined by the appended claims and otherwise appreciated by one of ordinary skill in the art. Thus, the breadth and scope of a preferred embodiment should not be limited by any of the above-described exemplary embodiments.

I claim:

1. A tilting skateboard truck comprising;
- a base,
- a suspension linkage, comprising,
  - a wheel shaft,
  - a torsion bar having a first attachment feature configured to attach to the wheel shaft and a second attachment feature,
  - a connecting shaft connected to the torsion bar at the second attachment feature,
  - a torque arm rigidly attached to the connecting shaft having a radius arm mount feature, and
  - a radius arm having a first end connected to the base and a
  - second end connected to the radius arm mount feature,
- a base spherical bushing attached to the connecting shaft and supported by the base.

2. The tilting skateboard truck of claim 1 wherein the base includes multiple attachment features configured to attach the radius arm first end and modify a steering ratio.

3. The tilting skateboard truck of claim 1, wherein the base spherical bushing is configured to adjust location relative to the base.

4. The tilting skateboard truck of claim 1, wherein the suspension linkage includes at least one elastic bushing rigidly supported on the connecting shaft and adjacent to the base spherical bushing configured to apply pressure to the base spherical bushing during tilting.

5. The tilting skateboard truck of claim 4 wherein the at least one elastic member is configured to be adjustable relative to the base spherical bushing such that pressure on the base spherical bushing is adjustable.

6. The tilting skateboard truck of claim 1 wherein the radius arm includes a length adjust device configured to position the first radius arm end relative to the second radius arm end.

7. The tilting skateboard truck of claim 6 wherein the first radius arm end includes a spherical bushing and second radius arm end includes a spherical bushing.

8. The tilting skateboard truck of claim 7 wherein the length adjustment device includes a length adjust screw having a left hand thread and a right hand thread.

9. The tilting skateboard truck of claim 8 wherein the first radius arm end includes left hand thread and second radius arm end includes right hand thread.

10. The tilting skateboard truck of claim 1 wherein the torsion arm first attachment feature is adjustable relative to the wheel shaft.

11. A skateboard having a tilting skateboard truck, the tilting skateboard truck comprising;
- a base,
- a suspension linkage, comprising,
  - a wheel shaft,
  - a torsion bar having a first attachment feature configured to attach to the wheel shaft and a second attachment feature,
  - a connecting shaft connected to the torsion bar at the second attachment feature,
  - a torque arm having a radius arm mount feature attached to the connecting shaft, and a radius arm having a first end connected to the base and a second end connected to the torque arm at the radius arm mount feature, and a base spherical bushing attached to the connecting shaft and supported by the base.

12. The skateboard of claim 11 wherein the skateboard is electrically powered.

13. The skateboard of claim 11 wherein the suspension linkage includes at least one elastic bushing rigidly supported on the connecting shaft and adjacent to the base spherical bushing configured to apply pressure to the base spherical bushing during tilting.

14. The skateboard of claim 13 wherein the at least one elastic member is configured to be adjustable relative to the base spherical bushing such that pressure on the base spherical bushing is adjustable.

15. The skateboard of claim 11 wherein the base spherical bushing is configured to adjust location relative to the base.

16. The skateboard of claim 11 wherein the base includes multiple attachment features configured to attach the radius arm first end and modify a steering ratio.

17. The method of adjusting a tilting skateboard truck, the tilting skateboard truck comprising;

a base, a suspension linkage, comprising, a wheel shaft, a torsion bar having a first attachment feature configured to attach to the wheel shaft and a second attachment feature, a connecting shaft connected to the torsion bar at the second attachment feature, a torque arm having a radius arm mount feature attached to the connecting shaft, and a radius arm having a first end connected to the base and a second end connected to the torque arm at the radius arm mount feature, and a base spherical bushing attached to the connecting shaft and supported by the base, the method comprising;

changing the length of the radius arm such that the steering ratio is adjusted.

18. The method of claim 17 wherein the base includes multiple radius arm attachment features and the method further includes, mounting the radius arm first end to one of the multiple radius arm attachment features such that the steering ratio is adjusted.

19. The method of claim 17 wherein the suspension linkage includes an elastic bushing preloaded against the base spherical bushing and the method further comprising, preloading the elastic bushing such that the preload is adjusted.

20. The method of claim of claim 17 wherein the base spherical bushing is further adjustably attached to the base, the method further comprising, adjusting the base spherical bushing relative to the base.

* * * * *